US010634012B2

(12) United States Patent
Tricaud et al.

(10) Patent No.: US 10,634,012 B2
(45) Date of Patent: Apr. 28, 2020

(54) FLOW AND PRESSURE ESTIMATORS IN A WASTE HEAT RECOVERY SYSTEM

(71) Applicant: Cummins Inc., Columbus, IN (US)

(72) Inventors: Christophe Tricaud, Columbus, IN (US); James A. Zigan, Versailles, IN (US)

(73) Assignee: Cummins Inc., Columbus, IN (US)

( * ) Notice: Subject to any disclaimer, the term of this patent is extended or adjusted under 35 U.S.C. 154(b) by 0 days.

(21) Appl. No.: 16/409,193

(22) Filed: May 10, 2019

(65) Prior Publication Data

US 2019/0264581 A1 Aug. 29, 2019

Related U.S. Application Data

(63) Continuation of application No. 14/974,497, filed on Dec. 18, 2015, now Pat. No. 10,287,923.

(51) Int. Cl.

| | |
|---|---|
| ***F01K 23/06*** | (2006.01) |
| ***F01K 27/02*** | (2006.01) |
| ***F01K 13/02*** | (2006.01) |

(52) U.S. Cl.

CPC ..... *F01K 23/065* (2013.01); *F01K 13/02* (2013.01); *F01K 27/02* (2013.01)

(58) Field of Classification Search

CPC ..... F01K 23/065; F01K 13/02; F01K 27/02

USPC ..... 60/670

See application file for complete search history.

(56) References Cited

U.S. PATENT DOCUMENTS

| | | | |
|---|---|---|---|
| 7,313,470 | B2 | 12/2007 | Zaremba et al. |
| 7,428,816 | B2 | 9/2008 | Singh et al. |
| 7,463,949 | B2 | 12/2008 | Tani et al. |
| 8,061,139 | B2 | 11/2011 | Bronicki |
| 2005/0247056 | A1 | 11/2005 | Cogswell et al. |
| 2005/0262858 | A1 | 12/2005 | Inaba et al. |
| 2009/0211253 | A1 | 8/2009 | Radcliff et al. |
| 2010/0251703 | A1 | 10/2010 | Takeishi et al. |
| 2011/0109157 | A1 | 5/2011 | Tani |
| 2011/0192163 | A1 | 8/2011 | Kasuya |
| 2011/0220729 | A1 | 9/2011 | Bucknell |

*Primary Examiner* — Jason D Shanske

(74) *Attorney, Agent, or Firm* — Foley & Lardner LLP

(57) ABSTRACT

An apparatus includes a pump circuit structured to receive pump data indicative of an operating characteristic of a pump feeding a fluid to a waste heat recovery (WHR) system; a flow circuit structured to receive valve position data indicative of a position of a valve downstream of the pump, estimate a flow rate of the fluid exiting the pump, and estimate the flow rate of the fluid exiting the valve; and a pressure circuit structured to receive pressure data indicative of the pressure of the fluid exiting the valve, estimate a change in pressure of the fluid across the WHR system, and determine a pressure of the fluid in a hot section of the WHR system based on the pressure of the fluid exiting the valve and the change in the pressure of the fluid across the WHR system.

20 Claims, 13 Drawing Sheets

FLOW AND PRESSURE ESTIMATORS IN A WASTE HEAT RECOVERY SYSTEM

STATEMENT REGARDING FEDERALLY SPONSORED RESEARCH OR DEVELOPMENT

This invention was made with government support under "Recovery Act—System Level Demonstration of Highly Efficient and Clean, Diesel Powered Class 8 Trucks (Supertruck)", Program Award Number DE-EE0003403 awarded by the Department of Energy (DOE). The government has certain rights in the invention.

BACKGROUND

Waste heat recovery (WHR) systems may recover waste heat energy from an internal combustion engine that would otherwise be lost. The more waste heat energy extracted from an internal combustion engine by a WHR system, the greater the potential efficiency of the engine. In other words, rather than the extracted heat being lost, the extracted heat energy may be repurposed to, for example, supplement the power output by the internal combustion engine, thereby increasing the efficiency of the system. During operation of the WHR system, various operating characteristics may be monitored. However, monitoring the operating characteristics of the WHR system requires sensors that are able to withstand the high temperatures and pressures within a hot section of the WHR system, and are therefore typically costly, difficult to install, and difficult to maintain in an appropriate operating condition.

SUMMARY

One embodiment relates to an apparatus. The apparatus includes a pump circuit, a flow circuit, and a pressure circuit. The pump circuit is structured to receive pump data indicative of an operating characteristic of a pump feeding a fluid to a waste heat recovery (WHR) system. The flow circuit is structured to receive valve position data indicative of a position of a valve downstream of the pump, estimate a flow rate of the fluid exiting the pump based on at least one of the operating characteristic of the pump and a pressure of the fluid exiting the valve, and estimate the flow rate of the fluid at an exit of the valve based on at least one of the flow rate of the fluid exiting the pump, the pressure of the fluid exiting the valve, and the position of the valve. The pressure circuit is structured to receive pressure data indicative of the pressure of the fluid at the exit of the valve, estimate a change in pressure of the fluid across the WHR system based on the flow rate of the fluid at the exit of the valve, and determine a pressure of the fluid in a hot section of the WHR system based on the pressure of the fluid at the exit of the valve and the change in the pressure of the fluid across the WHR system.

Another embodiment relates to a method. The method includes receiving pump data indicative of an operating characteristic of a pump feeding a fluid to a waste heat recovery (WHR) system; receiving valve position data indicative of a position of a valve downstream of the pump; receiving pressure data indicative of a pressure of the fluid at an exit of the valve; estimating a flow rate of the fluid exiting the pump based on at least one of the operating characteristic of the pump and the pressure of the fluid exiting the valve; estimating the flow rate of the fluid at the exit of the valve based on at least one of the flow rate of the fluid exiting the pump, the pressure of the fluid exiting the valve, and the position of the valve; estimating a change in pressure of the fluid across the WHR system based on the flow rate of the fluid at the exit of the valve; and determining a pressure of the fluid in a hot section of the WHR system based on the pressure of the fluid at the exit of the valve and the change in the pressure of the fluid across the WHR system.

Another embodiment relates to a waste heat recovery (WHR) system. The WHR system includes a pump fluidly coupled to the WHR system, a valve body positioned downstream and fluidly coupled to the pump, and a controller communicably coupled to the valve body and the pump. The valve body includes a valve positioned to selectively direct a flow of a fluid from the pump to at least one of a hot section and a cold section of the WHR system. The controller is structured to receive pump data indicative of an operating characteristic the pump; receive valve position data indicative of a position of the valve; receive pressure data indicative of a pressure of the fluid at an exit of the valve body; estimate a flow rate of the fluid exiting the pump based on at least one of the operating characteristic of the pump and the pressure of the fluid exiting the valve; estimate the flow rate of the fluid at the exit of the valve body based on the flow rate of the fluid exiting the pump, the pressure of the fluid exiting the valve body, and the position of the valve; estimate a change in pressure across the WHR system based on the flow rate of the fluid at the exit of the valve body; and determine a pressure of the fluid at the hot section of the WHR system based on the pressure of the fluid at the exit of the valve body and the change in the pressure of the fluid across the WHR system.

Advantages and features of the embodiments of this disclosure will become more apparent from the following detailed description of exemplary embodiments when viewed in conjunction with the accompanying drawings.

DETAILED DESCRIPTION

Following below are more detailed descriptions of various concepts related to, and implementations of, methods, apparatuses, and systems for determining a pressure of a working fluid in a hot section of a waste heat recovery system. The various concepts discussed in greater detail herein may be implemented in any number of ways, as the described concepts are not limited to any particular manner of implementation. Examples of specific implementations and applications are provided for illustrative purposes only.

Referring to the figures generally, the various embodiments disclosed herein relate to systems, apparatuses, and methods for determining a pressure of a working fluid within a hot section of a WHR system. According to the present disclosure, a controller determines a pressure of a working fluid within a hot section of a WHR system without pressure sensors or flow sensors (e.g., since positioning a physical pressure sensor within the hot section of a WHR system may be costly and inconvenient). The controller determines the pressure of the working fluid in the hot section based on various operating conditions of the WHR system and an engine coupled to the WHR system. As a brief overview, the WHR system may include a feedpump positioned within a cold section of the WHR system structured to feed a working fluid to a valve body that selectively directs the working fluid to various components in the cold section and the hot section of the WHR system. The controller is structured to estimate the flow rate of the working fluid at an exit of the feedpump and at an exit of a valve of the valve body positioned to direct a portion of the working fluid to at least one of the cold section and the hot section. The controller determines a pressure of the working fluid at the exit of the valve and a change in pressure across the WHR system (e.g., based on flow rate(s), valve position(s), pipe heat loss(es), etc.). The pressure of the working fluid in the hot section may be determined by the controller based on the fluid pressure across the WHR system (e.g., between the cold section and the hot section, etc.) and the fluid pressure at the exit of a valve (e.g., the point that separates the cold and hot sections, etc.).

Figure 1:
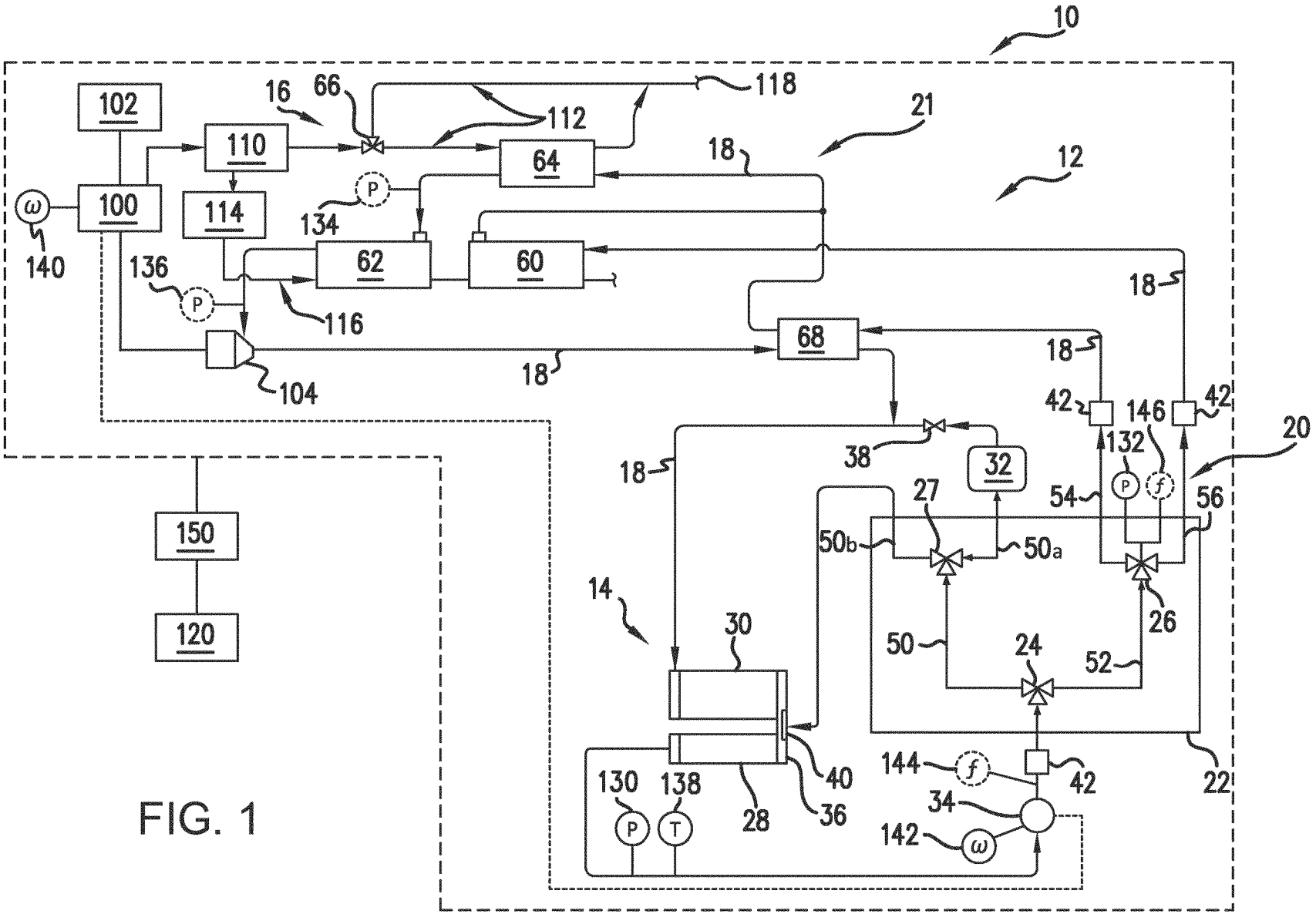
FIG. 1 is a schematic diagram of an engine system having a waste heat recovery system with a controller, according to an example embodiment.

Referring now to FIG. 1, a schematic diagram of an engine system 10 having a waste heat recovery (WHR) system 12 with a controller 150 is shown according to an example embodiment. The WHR system 12 is coupled to (e.g., in exhaust gas receiving communication with, etc.) an internal combustion engine, shown as engine 100. It should be noted that the engine 100 and WHR system 12 illustrated in FIG. 1 is an example configuration. Other configurations may include or exclude other and different components. For example, in some embodiments, an exhaust system of the engine system 10 may include one or more aftertreatment components, such as a diesel oxidation catalyst, a diesel particulate filter, and a selective catalytic reduction catalyst. Any such variation of the inventive concepts disclosed herein are intended to fall within the spirit and scope of the present disclosure.

According to one embodiment, the WHR system 12 is a Rankine cycle waste heat recovery system. The WHR system 12 may also be an organic Rankine cycle waste heat recovery system if a working fluid of the system is an organic high molecular mass fluid having a liquid-vapor phase change that is lower than the water-steam phase change. Examples of organic and inorganic Rankine cycle working fluids include Genetron® R-245fa made by Honeywell, Therminol®, Dowtherm J™ made by Dow Chemical Co., Fluorinol® made by American Nickeloid, toluene, dodecane, isododecane, methylundecane, neopentane, neopentane, octane, water/methanol mixtures, or steam, among other alternatives. According to one embodiment, the engine 100 is structured as a compression-ignition internal combustion engine that utilizes diesel fuel. However, in various alternate embodiments, the engine 100 may be structured as any other type of engine (e.g., spark-ignition, etc.) that utilizes any type of fuel (e.g., gasoline, natural gas, hydrogen, etc.).

According to one embodiment, the components of FIG. 1 are embodied in a vehicle. The vehicle may be structured as an internal combustion vehicle, a hybrid vehicle, or any other type of vehicle that may use a WHR system. The vehicle may include an on-road or an off-road vehicle including, but not limited to, line-haul trucks, mid-range trucks (e.g., pick-up trucks), cars, boats, tanks, airplanes, and any other type of vehicle that utilizes a WHR system. In operation, the engine 100 receives a chemical energy input (e.g., a fuel such as gasoline, diesel, etc.) that is combusted to generate mechanical energy in the form of a rotating crankshaft. By way of example, a transmission receives the rotating crankshaft and manipulates the speed of the crankshaft to affect a desired drive shaft speed. The rotating drive shaft is received by a differential, which provides the rotational energy of the drive shaft to a final drive (e.g., wheels, propeller, etc.). The final drive then propels or moves the vehicle. In various alternate embodiments, the controller 150 may be used with any engine system 10 that includes a WHR system (e.g., a stationary power generation system, etc.).

Referring still to FIG. 1, the WHR system 12 includes a first portion, shown as cold section 14, and a second portion, shown as hot section 16. As shown in FIG. 1, the cold section 14 includes a fluid management system 20 and the hot section 16 includes a heat exchange system 21. According to one embodiment, the WHR system 12 includes various pipes/conduits that define a WHR circuit 18. The WHR circuit 18 includes various flow paths for a working fluid to flow between the various components and sections of the WHR system 12. According to an example embodiment, the fluid management system 20 provides storage or containment, and cooling for a working fluid of the WHR system 12. As shown in FIG. 1, the fluid management system 20 includes a fluid control portion, shown as valve body 22, structured to regulate the flow of the working fluid throughout the WHR system 12 (e.g., to the cold section 14, the hot section 16, etc.). According to an example embodiment, the heat exchange system 21 provides cooling to certain systems of the engine system 10 and heats the working fluid to permit the working fluid to drive an energy conversion system 104 coupled to the engine 100 and the WHR system 12, thereby extracting useful work or energy from the waste heat (e.g., of the exhaust gas, etc.) created by the engine 100.

The engine 100 may be coupled to and/or include various engine accessories 102. The engine accessories may include, but are not limited to, a water pump, an air conditioning compressor, a power steering pump, and the like. As shown in FIG. 1, the engine 100 is coupled to an exhaust aftertreatment system 110. The exhaust aftertreatment system 110 is in exhaust gas-receiving communication with the engine 100. Air from the atmosphere is combined with fuel within the engine 100 and combusted to power the engine 100. Combustion of the fuel and air in the compression chambers of the engine 100 produces exhaust gas that is operatively vented to an exhaust manifold and the exhaust aftertreatment system 110. The exhaust aftertreatment system 110 may include various components to reduce harmful constituents (e.g., nitrogen oxides, soot, hydrocarbons, etc.) within the exhaust gas to compounds that are less environmentally harmful to comply with emissions standards. According to one embodiment, the exhaust aftertreatment system 110 includes piping (e.g., an exhaust pipe, etc.) for providing a flow path for the exhaust gas. In some embodiments, the piping defines an exhaust gas circuit 112.

According to the example embodiment shown in FIG. 1, the exhaust aftertreatment system 110 is coupled to (e.g., in exhaust gas communication with, etc.) an EGR system 114. According to one embodiment, the EGR system 114 includes piping that defines an EGR circuit 116 that defines a flow path for EGR gas. The EGR circuit 116 is structured to recirculate the EGR gas back to an intake of the engine 100 from the exhaust aftertreatment system 110. In one embodiment, the EGR system 114 includes an exhaust throttle structured to modulate (e.g., control, etc.) the exhaust flow through the exhaust aftertreatment system 110 and the EGR system 114.

As shown in FIG. 1, the fluid management system 20 includes a sub-cooler 28, a condenser 30, a receiver 32, and a feedpump 34. The receiver 32 serves as a reservoir for the WHR system 12. The condenser 30 is structured to convert gaseous working fluid to liquid working fluid. The sub-cooler 28 cools the liquid working fluid received from the condenser 30. The condenser 30 may be integrated with the sub-cooler 28, connected to the sub-cooler 28 by way of a conduit (e.g., pipe, hose, etc.), or may be commonly mounted with the sub-cooler 28 on a common base 36, which may include a plurality of fluid flow paths (not shown) to fluidly connect the condenser 30 to the sub-cooler 28. The receiver 32 may be physically elevated higher than the sub-cooler 28, and may be fluidly coupled to the sub-cooler 28. The receiver 32 may include a vent that may be opened to the condenser 30 by way of a vent valve 38. A fluid level sensor 40 may be positioned in a location suitable to determine the level of the liquid working fluid in the sub-cooler 28 and/or in the condenser 30. The feedpump 34 is positioned along the WHR circuit 18 downstream from the sub-cooler 28 and upstream from the valve body 22. The fluid management system 20 may also include one or more filter driers 42 positioned downstream from the valve body 22. In some embodiments, the filter drier 42 may be positioned downstream from the feedpump 34 and upstream of the valve body 22. All such variations are intended to fall within the spirit and scope of the present disclosure.

According to an example embodiment, the feedpump 34 is coupled to (e.g., driven by, etc.) the engine 100. Thus, the pump speed, and resultant flow rate of working fluid from the feedpump 34, may be based on the engine speed. In some embodiments, the feedpump 34 is a self-driven pump (e.g., includes an electric motor, etc.). The resultant flow rate of working fluid from the feedpump 34 may be modulated by a controller based on operational needs of the WHR system 12.

As shown in FIG. 1, the valve body 22 includes a plurality of valves structured to regulate flow as needed throughout WHR system 12. The valves may include at least one of an on-off valve, a proportional valve, a vent valve, and a passive check valve. In one embodiment, valve body 22 includes a passive ejector device that operates in conjunction with certain valves to draw liquid working fluid from the receiver 32. At least some of the valves and the ejector device may be included within the valve body 22. The various valves and the ejector device function to control the flow of working fluid in the WHR system 12. The valves and ejector device may control the heat transferred to and from the working fluid flowing through WHR system 12. According to an example embodiment, the valves are electrically actuated by the controller 150 (e.g., solenoid valves, etc.). The valves may be modulated valves capable of opening and closing rapidly or capable of directing the working fluid along various flow paths to adjust the amount of working fluid flowing through the cold section 14 and/or the hot section 16 of the WHR system 12.

The heat exchange system 21 includes an EGR boiler 60, an EGR superheater 62, an exhaust gas heat exchanger 64, an exhaust gas control valve 66, and a recuperator 68. The EGR boiler 60 may be structured to regulate the temperature of an EGR gas by transferring heat from the EGR gas to the working fluid. It will be appreciated that the term "EGR boiler" is used for convenience only and in no way is meant as limiting. The EGR boiler 60 may further be structured to cool the EGR gas and transfer heat from the EGR gas to the working fluid of WHR system 12. The exhaust gas heat exchanger 64 is structured to control the transfer of heat from the exhaust gas of the engine 100 to the working fluid. The amount of heat (i.e., exhaust flow) available to exhaust gas heat exchanger 64 may be at least partially determined by exhaust gas control valve 66. The EGR superheater 62 transfers additional heat energy from the EGR gas to the working fluid, which may be in a gaseous state when it enters the EGR superheater 62. The EGR superheater 62 is positioned along WHR circuit 18 downstream from exhaust gas heat exchanger 64 and upstream from condenser 30

The exhaust gas heat exchanger 64 is positioned along the exhaust gas circuit 112. The exhaust gas circuit 112 fluidly connects the exhaust aftertreatment system 110 to exhaust gas heat exchanger 64. The exhaust gas control valve 66 is positioned between the exhaust aftertreatment system 110 and the exhaust gas heat exchanger 64. Both the exhaust gas control valve 66 and the exhaust gas heat exchanger 64 are fluidly connected on their downstream sides by the exhaust gas circuit 112 to an atmospheric vent 118, which may be a tailpipe, exhaust pipe, exhaust stack, or the like, to vent the exhaust gas to an external environment.

The EGR superheater 62 and the EGR boiler 60 are connected to a portion of the EGR circuit 116. EGR gas flows along the EGR circuit 116 into the EGR superheater 62 and then downstream from EGR superheater 62 into the EGR boiler 60. From the EGR boiler 60, the EGR gas flows downstream along the EGR circuit 116 to at least one of the atmospheric vent 118 and the engine 100. The EGR superheater 62 and the EGR boiler 60 serve as heat exchangers for the EGR circuit 116, providing a cooling function for the EGR gas flowing through EGR superheater 62 and EGR boiler 60. The EGR superheater 62 and the EGR boiler 60 also serve as heat exchangers for the WHR circuit 18. For example, the EGR superheater 62 and the EGR boiler 60 may be structured to cause the temperature of the working fluid flowing through the EGR boiler 60 and the EGR superheater 62 to increase.

As shown in FIG. 1, the valve body 22 is positioned downstream of and fluidly coupled to the feedpump 34. The valve body 22 is structured to direct the fluid flow fed from the feedpump 34 to various flow path portions formed along the WHR circuit 18 that connect the feedpump 34 to various elements of the WHR system 12 (e.g., the recuperator 68, the EGR boiler 60, the condenser 30, etc.). The valve body 22 includes a first valve 24, a second valve 26 downstream of and fluidly coupled to the first valve 24, and in some embodiments, a third valve 27 downstream of and fluidly coupled to the first valve 24. The first valve 24 is positioned to selectively direct the flow of the working fluid from the feedpump 34 to at least one of a first flow path 50 and a second flow path 52. The first flow path 50 fluidly couples the feedpump 34 to the cold section 14 of the WHR system 12 and is structured to provide a portion (e.g., 0%, 20%, 50%, 100%, etc.) of the flow of the working fluid from the feedpump 34 to the cold section 14 (e.g., the receiver 32, the condenser 30, etc.). The third valve 27 is structured to direct the flow of the working fluid from the first flow path 50 to at least one of the receiver 32 along flow path 50*a* and the condenser 30 along flow path 50*b*. The vent valve 38 is positioned along the flow path 50*a* between the receiver 32 and the condenser 30. The vent valve 38 is structured to permit vapor to move into and out from the receiver 32 as liquid working fluid is moved out from and into the receiver 32 along the flow path 50*a*.

The second flow path 52 is fluidly coupled to the second valve 26 and structured to provide a portion of the flow of the working fluid from feedpump 34 to the second valve 26. The second valve 26 is positioned to selectively direct the flow of the working fluid received from the first valve 24 to at least one of a third flow path 54 and a fourth flow path 56. The third flow path 54 and the fourth flow path 56 fluidly couple the feedpump 34 to the hot section 16 of the WHR system 12. The third flow path 54 is structured to provide a portion of the flow of the working fluid from the feedpump 34 to the recuperator 68. The recuperator 68 is connected on a downstream side to the exhaust gas heat exchanger 64. The recuperator 68 is may also be positioned along the WHR circuit 18 between the energy conversion system 104 and the condenser 30, downstream from the energy conversion system 104 and upstream from the condenser 30.

The fourth flow path 56 is structured to provide a portion of the flow of the working fluid from the feedpump 34 to the EGR boiler 60. The exhaust gas heat exchanger 64 is positioned downstream from the EGR boiler 60, as well as the recuperator 68. Thus, any working fluid flow along third flow path 54 and any working fluid flow along fourth flow path 56 converges prior to entering exhaust gas heat exchanger 64.

The WHR system 12 may be structured to operate using any of the components described herein, though it will be appreciated that some embodiments of the WHR system 12 may include additional components or fewer components than those described. In operation, the sub-cooler 28 stores the liquid working fluid. The feedpump 34 pulls or draws liquid working fluid from the sub-cooler 28. The feedpump 34 then forces the liquid working fluid downstream to the valve body 22. The valve body 22 may direct the flow of liquid working fluid to one of four flow paths. As described above, the first flow path 50 connects the feedpump 34 to the cold section 14 of the WHR system 12 (e.g., the receiver 32, the condenser 30/sub-cooler 28, etc.), the second flow path 52 connects the first valve 24 to the second valve 26, the third flow path 54 connects the feedpump 34 to the recuperator 68, and the fourth flow path 56 connects the feedpump 34 to the EGR boiler 60. In some embodiments, the number and type of flow paths connecting the various components of the WHR system 12 may vary.

In some embodiments, less liquid working fluid flows through the first flow path 50 than the other flow paths (i.e., less liquid working fluid flows through the first flow path 50 directly to the cold section 14). In some embodiments, most of the liquid working fluid provided to the WHR circuit 18 by the feedpump 34 flows through at least one of the third flow path 54 and the fourth flow path 56 to the hot section 16 of the WHR system 12. In some embodiments, the flow of working fluid through the third flow path 54 and the fourth flow path 56 converge upstream of the exhaust gas heat exchanger 64.

The working fluid may be heated as a result of exhaust gas cooling in the exhaust gas heat exchanger 64 and/or EGR gas cooling in the EGR boiler 60. The working fluid may be further heated in the exhaust gas heat exchanger 64 and/or the EGR superheater 62 to obtain optimal superheating of the working fluid. The working fluid, which may be in a gaseous state due to being heated, flows from exhaust gas heat exchanger 64 into the EGR superheater 62. The superheated gaseous working fluid flows from the EGR superheater 62 into the energy conversion system 104. The flow of the working fluid through the WHR system 12 extracts heat energy. In some embodiments, the heat energy may be used by the energy conversion system 104 to transfer energy to another system or device.

The WHR system 12 is operatively coupled to the energy conversion system 104. The energy conversion system 104 is structured to produce additional work or transfer energy to another device or system (e.g., the engine 100, etc.). The energy conversion system 104 may be or include a turbine, piston, scroll, screw, or other type of expander device that rotates or otherwise moves as a result of an interaction with working fluid. In some embodiments, energy conversion system 104 can be used to transfer energy from one system to another system (e.g., to transfer heat energy from WHR system 12 to a fluid for a heating system). The energy conversion system 104 may be positioned along the WHR circuit 18 downstream from the EGR superheater 62 and upstream from the condenser 30.

In some embodiments, the WHR system 12 includes a controller 150 structured to perform certain operations to control or regulate the flow of the working fluid through the WHR system 12. The controller 150 may be structured to control operation of the WHR system 12, the engine 100, and/or any associated sub-system, such as the valve body 22, the feedpump 34, and the energy conversion system 104, among others. Communication between and among the components may be via any number of wired or wireless connections (e.g., any standard under IEEE 802, etc.). For example, a wired connection may include a serial cable, a fiber optic cable, a CAT5 cable, or any other form of wired connection. In comparison, a wireless connection may include the Internet, Wi-Fi, cellular, Bluetooth, ZigBee, radio, etc. In one embodiment, a controller area network (CAN) bus provides the exchange of signals, information, and/or data. The CAN bus can include any number of wired and wireless connections that provide the exchange of signals, information, and/or data. The CAN bus may include a local area network (LAN), or a wide area network (WAN), or the connection may be made to an external computer (for example, through the Internet using an Internet Service Provider).

Because the controller 150 is communicably coupled to the systems and components of FIG. 1, the controller 150 may be structured to receive various information and/or data regarding operation of the WHR system 12 and the engine 100. To facilitate control by the controller 150, one or more sensors may be strategically positioned within the WHR system 12 and communicatively coupled to the controller 150. The sensors may include, but are not limited to, temperature sensors, pressure sensors, flow sensors, speed sensors, etc. In some embodiments, the sensors may be structured to communicate with circuit implementation elements of the controller 150, and may include datalink and/or network hardware, communication chips, oscillating crystals, communication links, cables, twisted pair wiring, coaxial wiring, shielded wiring, transmitters, receivers, and/or transceivers, logic circuits, hard-wired logic circuits, reconfigurable logic circuits in a particular non-transient state structured according to the circuit specification, an actuator (e.g., an electrical, hydraulic, or pneumatic actuator), a solenoid, an op-amp, analog control elements (e.g., springs, filters, integrators, adders, dividers, gain elements), and/or digital control elements, among others.

Referring still to FIG. 1, the WHR system 12 may include various sensors operatively positioned to measure various data regarding operation of the WHR system 12. As shown in FIG. 1, the WHR system 12 may include a first pressure sensor 130 positioned downstream of the sub-cooler 28 and upstream of the feedpump 34 in the cold section 14 of the WHR system 12. According to an example embodiment, the first pressure sensor 130 is structured to acquire pressure data indicative of a pressure of the working fluid upstream of the feedpump 34. In some embodiments, the WHR system 12 may include a second pressure sensor 132 positioned downstream of the second valve 26. According to an example embodiment, the second pressure sensor 132 is structured to acquire pressure data indicative of a pressure of the working fluid downstream of the second valve 26 (e.g., the pressure of the working fluid exiting the valve body 22, etc.). In one embodiment, the pressure data is indicative of the pressure of the working fluid exiting the second valve 26 into the third flow path 54. In one embodiment, the pressure data is indicative of the pressure of the working fluid exiting the second valve 26 into the fourth flow path 56. In some embodiments, the pressure data is indicative of the pressure of the working fluid exiting the second valve 26 into both the third flow path 54 and the fourth flow path 56. In some embodiments, the WHR system 12 includes additional pressure sensors positioned throughout the WHR system 12 and structured to acquire pressure data indicative of a pressure of the working fluid entering or exiting various components of the WHR system 12 (e.g., the energy conversion system 104, the EGR superheater 62, etc.) and/or the pressure of the working fluid at various locations in the hot section 16 of the WHR system 12.

The WHR system 12 may include a temperature sensor 138 positioned downstream of the sub-cooler 28 and upstream of the feedpump 34 in the cold section 14 of the WHR system 12. According to an example embodiment, the temperature sensor 138 is structured to acquire temperature data indicative of a temperature of the working fluid in the cold section 14 of the WHR system 12. In some embodiments, the WHR system 12 includes additional temperature sensors positioned throughout the WHR system 12 structured to acquire temperature data indicative of a temperate of the working fluid entering or exiting various components of the WHR system 12 (e.g., the energy conversion system 104, the EGR superheater 62, etc.) and/or the temperature of the working fluid in the hot section 16 of the WHR system 12.

The engine 100 may include or be coupled to one or more sensors structured to acquire engine operation data regarding operation of the engine 100. The engine operation data may be indicative of engine speed, vehicle speed, engine temperature, engine torque, engine power, exhaust flow, and so on, received via one or more sensors. In one embodiment, the engine 100 includes a speed sensor 140 structured to acquire engine speed data indicative of a speed of the engine 100. In some embodiments, the engine speed data is used to determine the speed of the feedpump 34 and the flow rate of the working fluid exiting the feedpump 34. In some embodiments, the feedpump 34 includes a speed sensor 142 structured to acquire pump speed data indicative of a speed of the pump and the flow rate of the working fluid exiting the feedpump 34.

In some embodiments, monitoring operating characteristics of the hot section 16 of the WHR system 12 with sensors may be costly or inconvenient due to the high temperatures and pressures of the working fluid flowing through this section. Accordingly, in some embodiments, the WHR system 12 includes various virtual sensors instead of an actual physical sensor. In such embodiments, the pressure, temperature, and/or flow rate of the working fluid at various locations may be estimated, determined, or otherwise correlated with various operating conditions of the engine 100 and the WHR system 12. For example, in one embodiment, the WHR system 12 includes a first virtual pressure sensor 134. The first virtual pressure sensor 134 may represent a location at which the controller 150 is structured to determine the pressure of the working fluid within the hot section 16 (e.g., at a location between the exhaust gas heat exchanger 64 and the EGR superheater 62). In some embodiments, the WHR system 12 includes a second virtual pressure sensor 136. The second virtual pressure sensor 136 may represent a location at which the controller 150 is structured to determine the pressure of the working fluid within the hot section 16 (e.g., at a location between the EGR superheater 62 and the energy conversion system 104). In some embodiments, the WHR system 12 includes a first virtual flow rate sensor 144. The first virtual flow rate sensor 144 may represents a location at which the controller 150 is structured to determine the flow rate (e.g., volume flow rate, mass flow rate, etc.) of the working fluid exiting the feedpump 34. In some embodiments, the WHR system 12 includes a second virtual flow rate sensor 146. The second virtual flow rate sensor 146 may represent a location at which the controller 150 is structured to determine the flow rate of the working fluid exiting the second valve 26 of the valve body 22 into the hot section 16.

The controller 150 may be structured to determine the pressure (or temperature, flow rate, etc.) of the working fluid in the hot section 16 utilizing a look-up table that correlates various operating conditions with pressure (or temperature, flow rate, etc.). In some embodiments, the look-up table is based on data from test results. The controller 150 may utilize any of a model, formula, equation, process, and the like to determine a pressure (or temperature, flow rate, etc.) at various locations without the use of a physical sensor. For example, such an embodiment may be beneficial in WHR system architectures that are positioned in tight spaces because no electrical circuitry is required to power and establish a communication protocol with physical sensors.

Furthermore, maintenance and replacement costs associated with such embodiments may be substantially reduced by reducing the number of physical sensors used.

As shown in FIG. 1, the engine system 10 may be communicably coupled with an operator input/output (I/O) device 120 that is communicably coupled with the controller 150, such that information may be exchanged between the controller 150, the I/O device 120, and the engine system 10. The information may relate to one or more components of FIG. 1. The operator I/O device 120 may be structured to enable an operator of the engine system 10 to communicate with the controller 150 and one or more components of the engine system 10. For example, the operator input/output device 120 may include, but is not limited to, an interactive display, a touchscreen device, one or more buttons and switches, voice command receivers, etc. In some embodiments, the controller 150 may be implemented with non-vehicular applications (e.g., a power generator, etc.) and the operator I/O device 120 may be specific to those applications. For example, in some embodiments, the operator I/O device 120 may include a laptop computer, a tablet computer, a desktop computer, a phone, a watch, a personal digital assistant, etc. Via the I/O device 120, the controller 150 may provide data readouts, fault messages, and/or service notifications based on the operation of the engine system 10 (e.g., the WHR system 12, the engine 100, the exhaust aftertreatment system 110, etc.).

In one embodiment, the controller 150 may be communicably coupled to the engine system 10 as an add-on to an electronic control circuit. In some embodiments, the controller 150 may be a stand-alone tool that performs any data logging, data tracking, data analysis, and so on, needed to monitor operation of the WHR system 12. In some embodiments, the controller 150 is included in the electronic control circuit of a vehicle. The electronic control circuit may include a transmission control unit and any other vehicle control unit (e.g., an exhaust aftertreatment control unit, powertrain control circuit, engine control circuit, etc.). In one embodiment, the controller 150 is web based, server based, and/or application based (e.g., a smartphone app, an internet-based controller, etc.). The structure and function of the controller 150 is further described with regard to FIG. 2.

Figure 2:
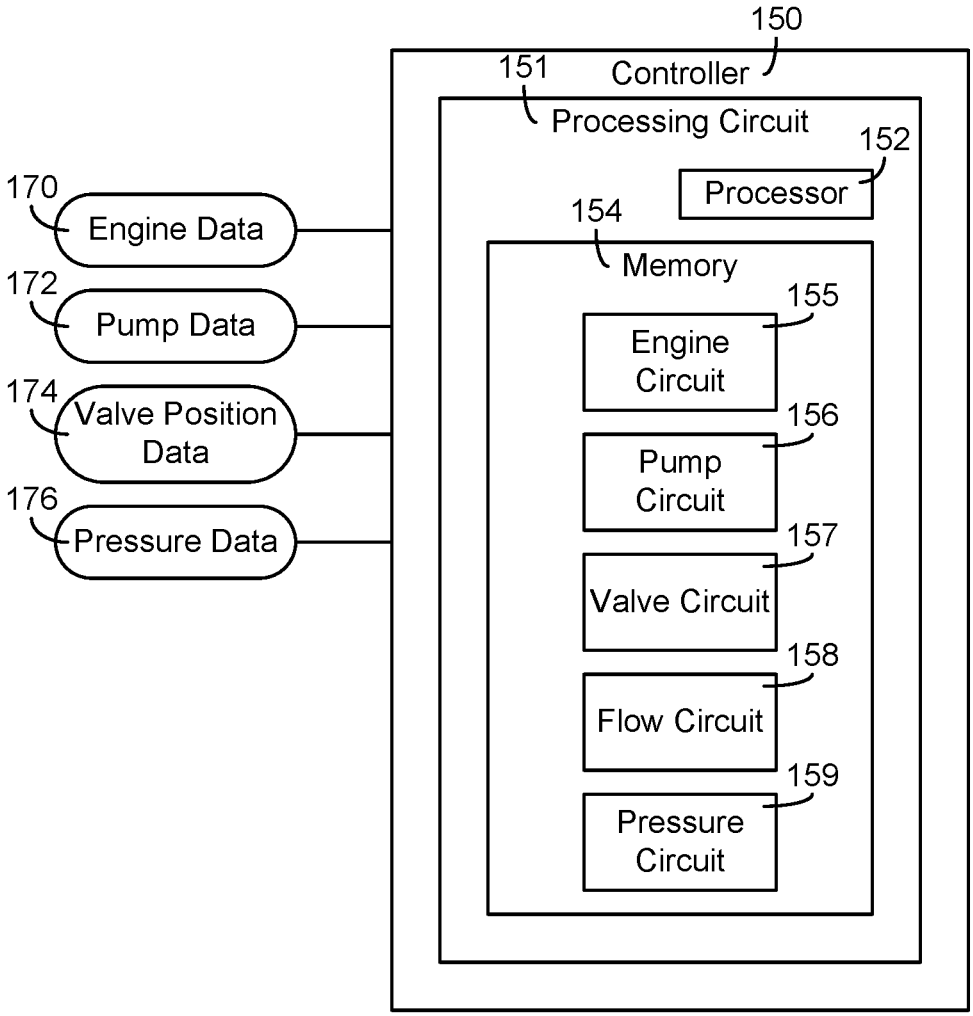
FIG. 2 is a schematic diagram of the controller for the waste heat recovery system, according to an example embodiment.

Referring now to FIG. 2, a schematic diagram of the controller 150 for the WHR system 12 is shown according to an example embodiment. The controller 150 includes a processing circuit 151 that includes a processor 152 and a memory 154. The processor 152 may be implemented as a general-purpose processor, an application specific integrated circuit (ASIC), one or more field programmable gate arrays (FPGAs), a digital signal processor (DSP), a group of processing components, or other suitable electronic processing components. The memory 154 (e.g., RAM, ROM, Flash Memory, hard disk storage, etc.) may include one or more memory devices structured to store data and/or computer code for facilitating the various processes described herein. Thus, the memory 154 may be communicably connected to the processor 152 and provide computer code or instructions to the processor 152 for executing the processes described in regard to the controller 150. Moreover, the memory 154 may be or include tangible, non-transient volatile memory or non-volatile memory. Accordingly, the memory 154 may include database components, object code components, script components, or any other type of information structure for supporting the various activities and information structures described herein.

The memory 154 includes various circuits for completing the activities described herein, including an engine circuit 155, a pump circuit 156, a valve circuit 157, a flow circuit 158, and a pressure circuit 159. The circuits 155, 156, 157, 158, 159 are structured to determine a pressure of the working fluid flowing through the hot section 16 of the WHR system 12. While various circuits with particular functionality are shown in FIG. 2, it will be understood that the controller 150 and memory 154 may include any number of circuits for completing the functions described herein. For example, the processes carried out by multiple circuits may be combined within a single circuit or by additional circuits with additional functionality. In some embodiments, the controller 150 is structured to control other activity beyond the scope of the present disclosure.

Certain operations of the controller 150 described herein include operations to interpret and/or to determine one or more parameters. Interpreting or determining parameters, as utilized herein, includes receiving values by any method known in the art, including at least receiving values from a datalink or network communication, receiving an electronic signal (e.g. a voltage, frequency, current, or PWM signal) indicative of the value, receiving a computer generated parameter indicative of the value, reading the value from a memory location on a non-transient computer readable storage medium, receiving the value as a run-time parameter by any means known in the art, and/or by receiving a value by which the interpreted parameter can be calculated, and/or by referencing a default value that is interpreted to be the parameter value.

The engine circuit 155 is structured to receive engine data 170 indicative of operating characteristics of the engine 100. According to an example embodiment, the operating characteristics include a speed of the engine 100. The engine circuit 155 may be communicably coupled to one or more sensors, such as the speed sensor 140, that is structured to acquire the engine data 170. The engine circuit 155 may include communication circuitry (e.g., relays, wiring, network interfaces, circuits, etc.) that facilitate the exchange of information, data, values, non-transient signals, etc. between and among the engine circuit 155 and the one or more sensors. In some embodiments, the engine circuit 155 may include or be communicably coupled to the engine 100 as a means for controlling operation of the engine 100.

The pump circuit 156 is structured to receive pump data 172 indicative of an operating characteristic of the feedpump 34. According to an example embodiment, the operating characteristic of the feedpump 34 includes a pump speed. In one embodiment, the pump data 172 is determined from the engine data 170 (e.g., the pump speed is associated with the engine speed, etc.). Thus, the pump circuit 156 may receive the engine data 170 from the engine circuit 155. In another embodiment, the pump data 172 is acquired via one or more sensors, such as speed sensor 142. The pump circuit 156 may include communication circuitry (e.g., relays, wiring, network interfaces, circuits, etc.) that facilitates the exchange of information, data, values, non-transient signals, etc. between and among the pump circuit 156, the engine circuit 155, and/or the one or more sensors. In some embodiments, the pump circuit 156 may include or be communicably coupled to the feedpump 34 as a means for controlling operation of the feedpump 34. For example, the pump circuit 156 may control the pump speed and/or the flow rate of working fluid exiting the feedpump 34.

The valve circuit 157 is structured to receive valve position data 174 indicative of a position (e.g., an amount open, closed, etc.) of one or more of the valves (e.g., the first valve 24, the second valve 26, etc.) of the valve body 22. The valve circuit 157 may include communication circuitry (e.g., relays, wiring, network interfaces, circuits, etc.) that facilitates the exchange of information, data, values, non-transient signals, etc. between and among the valve circuit 157, the one or more valves, and/or one or more valve position sensors. In some embodiments, the valve circuit 157 may include or be communicably coupled to the valve body 22 as a means for controlling operation of the valves (e.g., open, close, etc.) of the valve body 22 (e.g., the valve positions, etc.). The valve circuit 157 may be structured to selectively control a position of at least one of the valves of the valve body 22. More specifically, the valve circuit 157 is structured to selectively engage the valves of the valve body 22 to direct a portion of the working fluid exiting the feedpump to at least one of the cold section 14 and the hot section 16 of the WHR system 12.

According to an example embodiment, the position of the valves of the valve body 22 provided by the valve position data 174 indicates a portion of the working fluid exiting the feedpump 34 that enters at least one of the cold section 14 and the hot section 16 of the WHR system 12. By way of example, the valve circuit 157 may regulate the position of the first valve 24 to adjust an amount of working fluid that exits the feedpump 34 and is directed along at least one of the first flow path 50 to the cold section 14 and the second flow path 52 to the second valve 26. In another example, the valve circuit 157 may regulate the position of the second valve 26 to adjust an amount of working fluid received from the first valve 24 and directed to the hot section 16 along at least one of the third flow path 54 to the recuperator 68 and the fourth flow path 56 to the exhaust gas heat exchanger 64. In another example, the valve circuit 157 may regulate the position of the third valve 27 to adjust an amount of working fluid entering the cold section 14 and directed to at least one of the condenser 30 and the receiver 32.

The flow circuit 158 is structured to estimate the flow rate of the working fluid at various locations of the WHR system 12 based on various operating characteristics of the WHR system 12 and/or the engine 100. In some embodiments, the flow circuit 158 estimates the flow rate based on the type and temperature of the working fluid. The flow circuit 158 may estimate the flow rate of the working fluid based on the engine data 170, the pump data 172, and/or the valve position data 174 received from one or more of the engine circuit 155, the pump circuit 156, and the valve circuit 157. The flow circuit 158 may include communication circuitry (e.g., relays, wiring, network interfaces, circuits, etc.) that facilitates the exchange of information, data, values, non-transient signals, etc. between and among the circuits 155, 156, 157, 158, 159. For example, the flow circuit 158 may receive pressure and temperature data from the first pressure sensor 130 and the temperature sensor 138, respectively. The flow circuit 158 may be structured to estimate the flow rate of the working fluid exiting the feedpump 34. The estimated flow rate of the working fluid exiting the feedpump 34 may be based on a function of the pump speed. In one embodiment, the feedpump 34 is driven by the engine 100 and the pump speed is a function of engine speed. The flow rate of the working fluid exiting the feedpump 34 may also be based on the temperature and pressure of the working fluid.

Figure 3:
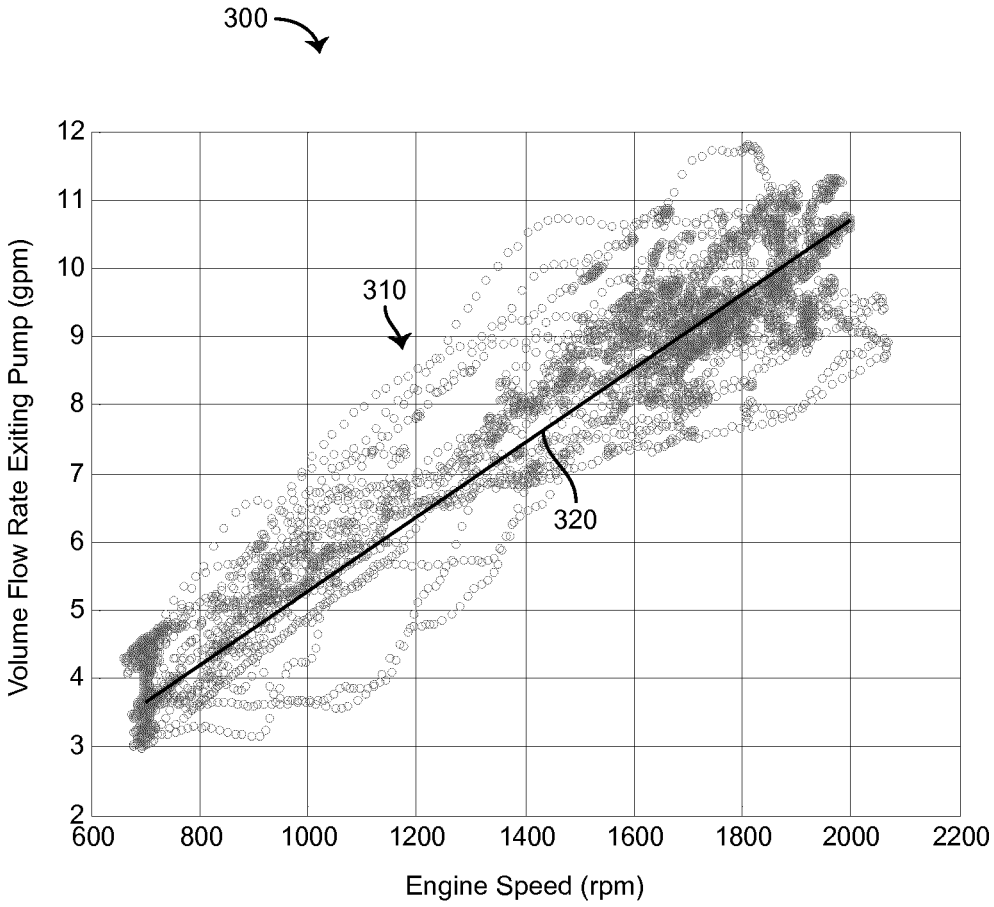
FIG. 3 is a graph of engine speed and an associated volume flow rate exiting a pump of the waste heat recovery system, according to an example embodiment.

Referring to FIG. 3, a graph 300 of engine speed and an associated volume flow rate exiting a pump of the WHR system 12 is shown according to an example embodiment. As shown in FIG. 3, the graph 300 includes measured flow data 310 and a flow rate regression curve 320. The measured flow data 310 represents the flow rate of the working fluid exiting the feedpump 34 for various speeds of the engine 100 (e.g., the engine data 170, etc.) according to an example embodiment. The flow rate regression curve 320 may be fit to the measured flow data 310 to determine the flow rate of the working fluid as a function of engine speed for a given WHR system. In one non-limiting exemplary embodiment, the flow rate of the working fluid exiting the feedpump 34 is based on the following relationship (Equation 1):

$$f=a\cdot\omega+b$$

where f is the flow rate of the working fluid, ω is the engine speed, and a and b are determined constants for the WHR system 12. Thus, the flow circuit 158 may be structured to estimate the flow rate of the working fluid exiting the feedpump 34 using an equation, a look-up table, an algorithm, a model, or otherwise based on Equation 1 for the feedpump 34 and engine 100 of the WHR system 12. In some embodiments, the flow rate of the working fluid exiting the feedpump 34 is additionally or alternatively based on a function of pump speed. For example, if the feedpump 34 is an electric pump, the flow rate of the working fluid exiting the feedpump 34 may be based on the speed of the feedpump 34.

Figure 4:
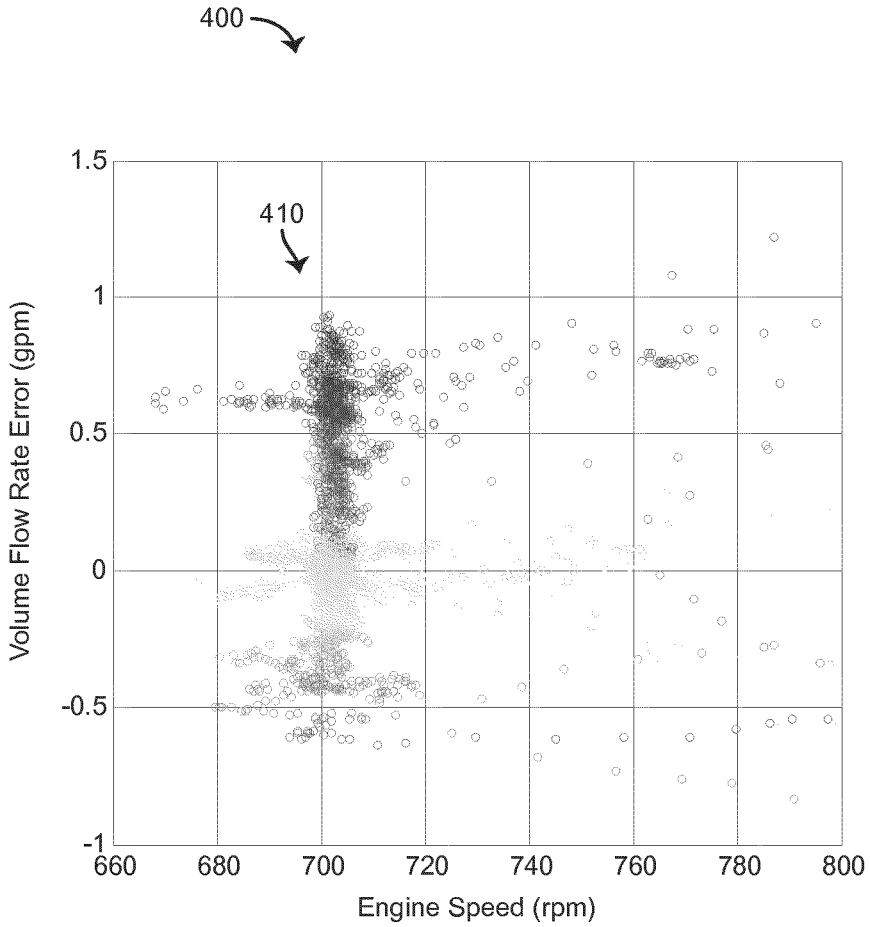
FIG. 4 is a graph of engine speed and an associated volume flow rate error of a pump of the waste heat recovery system, according to an example embodiment.

In some embodiments, the flow rate and/or the pressure of the working fluid exiting the feedpump 34 is affected by at least one of the speed of the engine 100 (e.g., indicated by the engine data 170, etc.), the speed of the feedpump 34 (e.g., indicated by the pump data 172, etc.) and/or the position of the first valve 24 (e.g., indicated by the valve position data 174, etc.). Referring now to FIG. 4, a graph 400 of engine speed and an associated volume flow rate error of a pump of the WHR system 12 is shown according to an example embodiment. As shown in FIG. 4, the graph 400 includes error data 410. The error data 410 represents the error of the flow rate of the working fluid exiting the feedpump 34 for various pressures of the working fluid and/or speeds of the engine 100 according to an example embodiment. The error in the flow rate may occur at substantially low engine speeds (e.g., engine idle, less than 800 RPM, etc.). The flow circuit 158 is further structured to apply a pressure correction factor to the estimate of the flow rate of the working fluid exiting the feedpump 34 based on the pressure data 172 in response to the engine data 170 indicating that the speed of the engine 100 is below a speed threshold (e.g., less than 800 RPM, etc.). The pressure correction factor may be determined by the flow circuit using a look-up table, a function, an algorithm, a model, and/or the like for a given pressure exiting the second valve 26.

Figure 5:
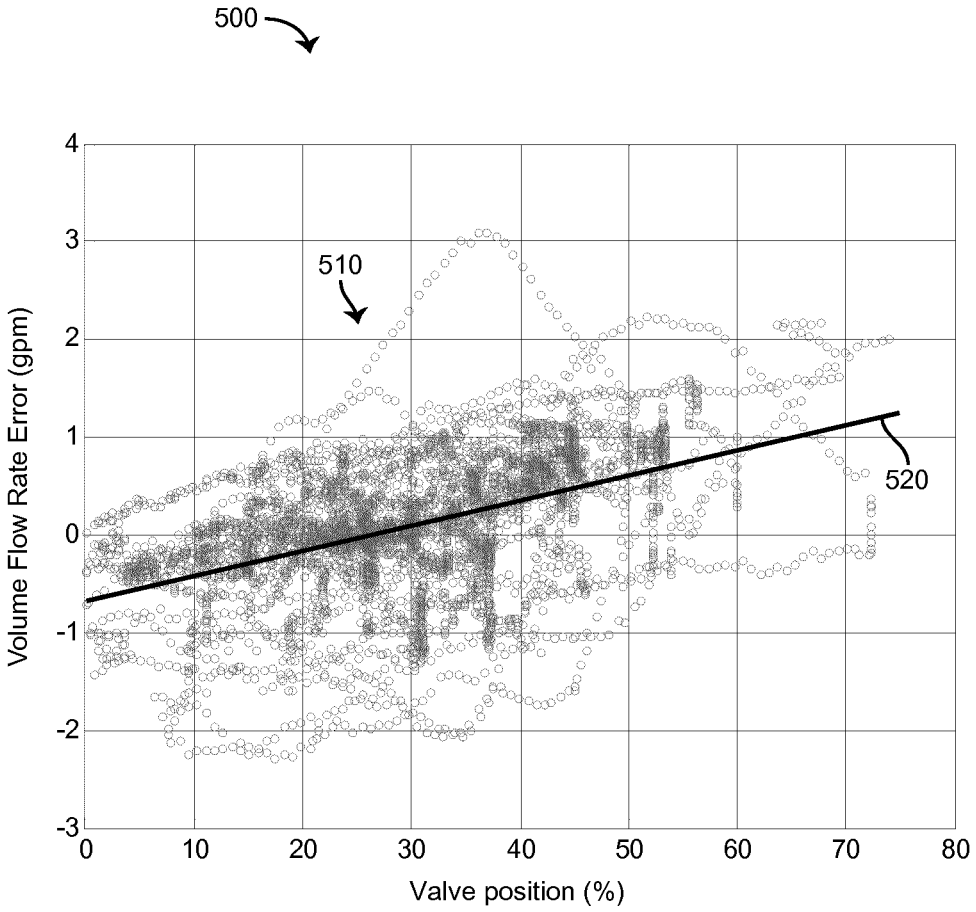
FIG. 5 is a graph of valve position and an associated volume flow rate error of a pump of the waste heat recovery system, according to an example embodiment.

Referring now to FIG. 5, a graph 500 of valve position and an associated volume flow rate error of a pump of the WHR system 12 is shown according to an example embodiment. As shown in FIG. 5, the graph 500 includes position error data 510 and a valve position error curve 520. The position error data 510 represents the error of the flow rate of the working fluid exiting the feedpump 34 for various positions of the first valve 24 according to an example embodiment. A correlation between the position of the first valve 24 and an error of the flow rate of the working fluid exiting the feedpump 34 may be observed, as represented by the valve position error curve 520. The flow circuit 158 is further structured to adjust the estimate of the flow rate of the working fluid exiting the feedpump 34 with a position correction factor based on the position of the first valve 24 (e.g., indicated by the valve position data 174, etc.). The position correction factor may be determined by the flow circuit 158 using a look-up table, a function, an algorithm, a model, and/or the like for a given pressure exiting the second valve 26.

Figure 6:
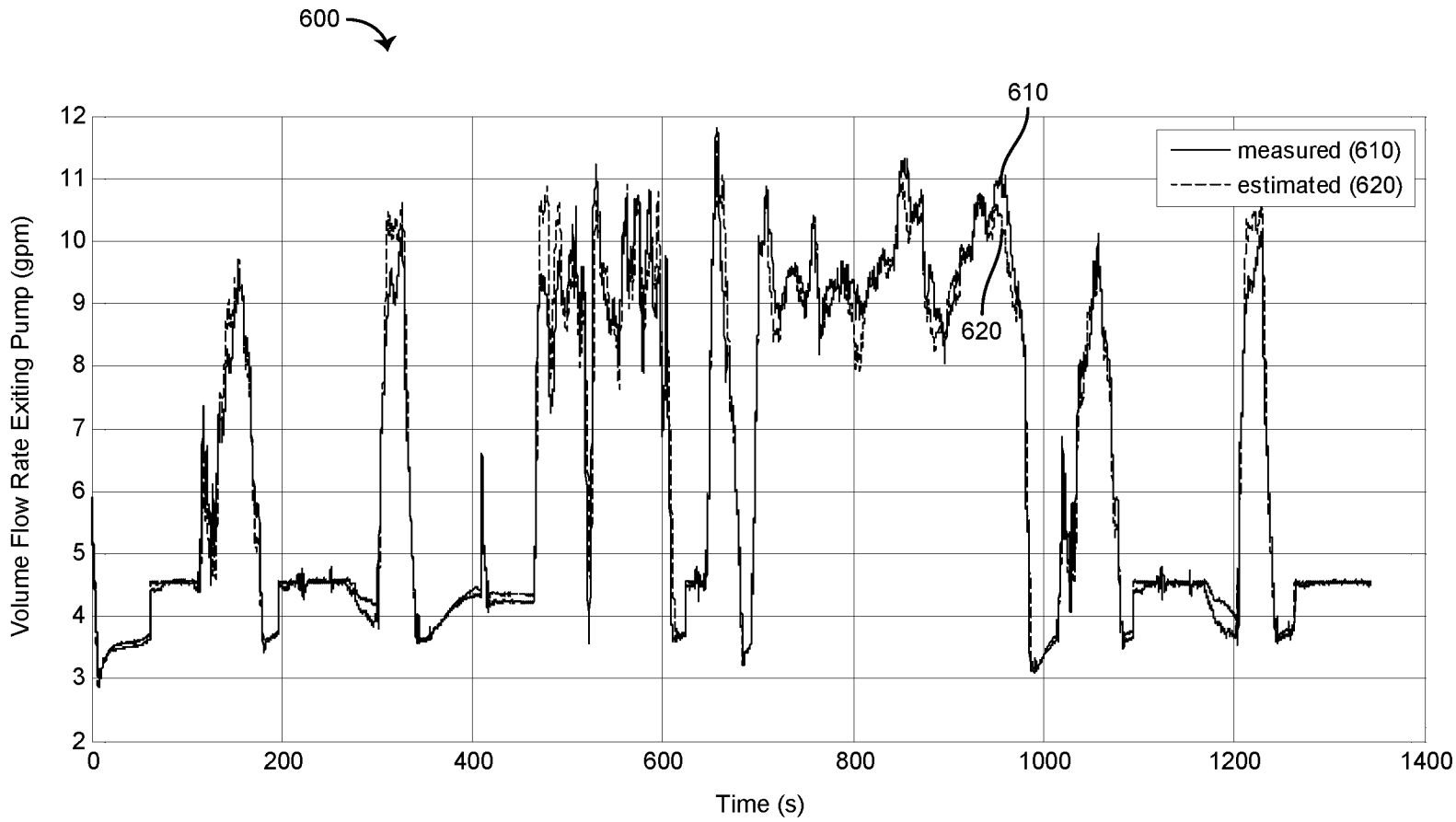
FIG. 6 is a graph of a measured and an estimated volume flow rate exiting a pump of the waste heat recovery system over time, according to an example embodiment.

Referring now to FIG. 6, a graph 600 of a measured and an estimated volume flow rate exiting a pump of the WHR system 12 over time is shown according to an example embodiment. As shown in FIG. 6, the graph 600 includes measured flow data 610 and estimated flow data 620. The measured flow data 610 represents the actual flow rate of the working fluid exiting the feedpump 34 for various engine speeds and valve positions during operation of the WHR system 12. The estimated flow data 620 represents the estimated flow rate of the working fluid exiting the feedpump 34 by the flow circuit 158 for various speeds of the engine 100 (e.g., indicated by the engine data 170, etc.) and valve positions of the first valve 24 (e.g., indicated by the valve position data 174, etc.) during operation of the WHR system 12. As shown in FIG. 6, the flow circuit 158 is capable of estimating the flow rate of the working fluid exiting the feedpump 34 based on the speed of the engine 100, the speed of the feedpump 34, and/or the position of the first valve 24 with minimal or no error. Some of the error in the estimation may occur at the beginning of transients after a period of idle (e.g., the time constant of the flow is slower than the engine speed, etc.). In some embodiments, filtering (e.g., first order filtering, etc.) may be applied to the estimate of the flow rate exiting the feedpump 34 with the time constant being based on a relevant variable (e.g., a pressure difference across the feedpump 34, a temperature of the working fluid exiting the sub-cooler 28 measured by the temperature sensor 138, etc.).

Referring back to FIGS. 1-2, the flow circuit 158, as indicated by the second virtual flow sensor 146, is structured to estimate the flow rate of the working fluid exiting the second valve 26 of the valve body 22. The flow rate of the working fluid exiting the second valve 26 may be based on at least one of the flow rate of the working fluid exiting the feedpump 34, the position of the first valve 24, the position of the second valve 26, and the pressure of the working fluid exiting the second valve 26. In some embodiments, the flow rate of the working fluid exiting the second valve 26 along the third flow path 54 is based on the flow rate of the working fluid exiting the feedpump 34, the position of the first valve 24, the position of the second valve 26, and/or the pressure of the working fluid exiting the second valve 26 along the third flow path 54. The flow rate of the working fluid exiting the second valve 26 along the fourth flow path 56 may be based on the flow rate of the working fluid exiting the feedpump 34, the position of the first valve 24, the position of the second valve 26, and/or the pressure of the working fluid exiting the second valve 26 along the fourth flow path 56. In some embodiments, the flow circuit 158 may also be structured to determine the flow rate of the working fluid exiting the first valve 24 into at least one of the first flow path 50 and the second flow path 52 based on the flow rate of the working fluid exiting the feedpump 34 and the position of the first valve 24. In some embodiments, the flow circuit 158 applies a filter to the estimated flow rates for low engine speeds (e.g., low flow rates, based on a pressure correction factor, etc.).

Figure 7:
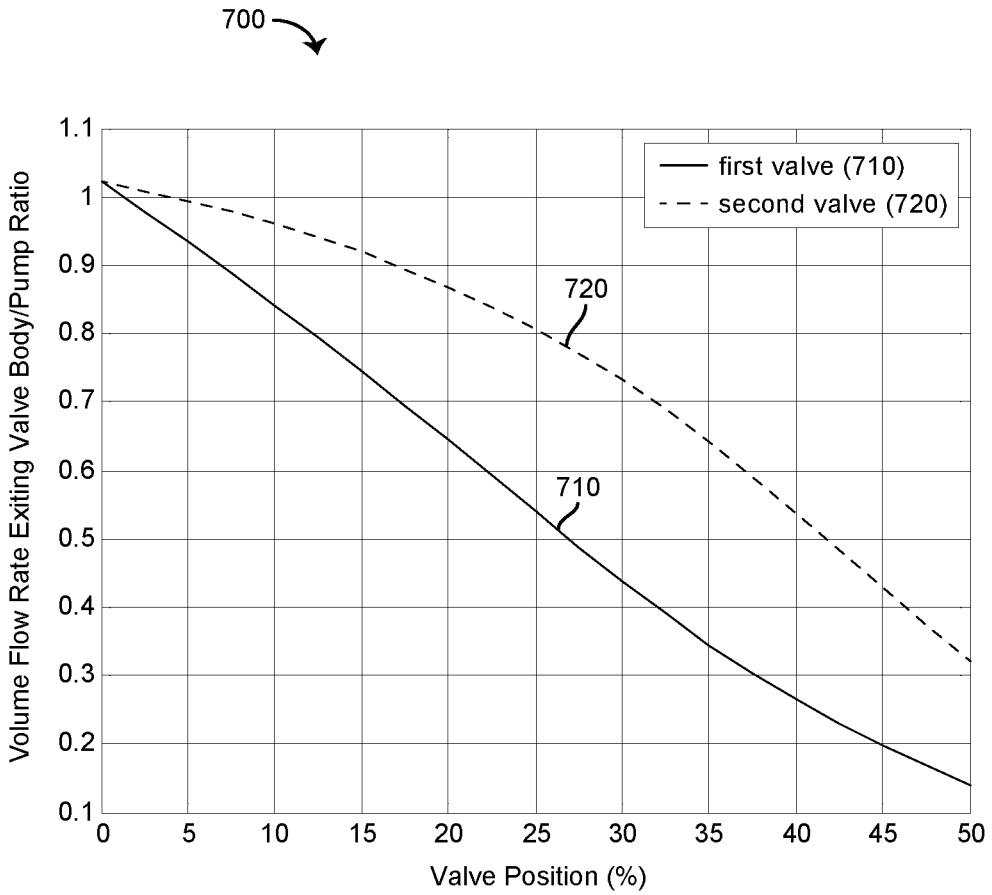
FIG. 7 is a graph of a ratio of a volume flow rate exiting a valve body and a pump of the waste heat recovery system based on valve position, according to an example embodiment.

Referring now to FIG. 7, a graph 700 of a ratio of a volume flow rate exiting a valve body and a pump of the WHR system 12 based on valve position (e.g., position of the first valve 24 and the second valve 26) is shown according to an example embodiment. As shown in FIG. 7, the graph 700 includes a first value curve 710 and a second valve curve 720. The first valve curve 710 and the second valve curve 720 may be experimentally determined to correlate the flow rate exiting the feedpump 34 and the valve body 22 to the valve positions. The first valve curve 710 and the second valve curve 720 represent the ratio of the flow rate of the working fluid through the valve body 22 to the feedpump 34 based on the positions of the first valve 24 and the second valve 26. For example, if the first valve 24 directs all the flow to the second valve 26 (i.e., valve position of 0%), and the second valve directs all of the flow to the third flow path 54 (i.e., valve position of 0%), the flow rate of the working fluid exiting the feedpump 34 is substantially identical to the flow rate exiting the valve body 22 along the third flow path 54 (i.e., a ratio of 1:1). The flow circuit 158 is structured to estimate the flow rate of the working fluid exiting the second valve 26 along the third flow path 54 using a look-up table, algorithm, model, or the like based on the valve positions of the first valve 24 and the second valve 26, and the flow rate exiting the feedpump 34. The flow circuit 158 may then estimate the flow rate along the fourth flow path 56 based on the estimated flow rate of the working fluid flowing along the third flow path 54, the estimated flow rate of the working fluid exiting the feedpump 34, the position of the first valve 24 and the second valve 26, and/or the pressure of the working fluid exiting the second valve 26 along the third flow path 54 and/or the fourth flow path 56.

Figure 8:
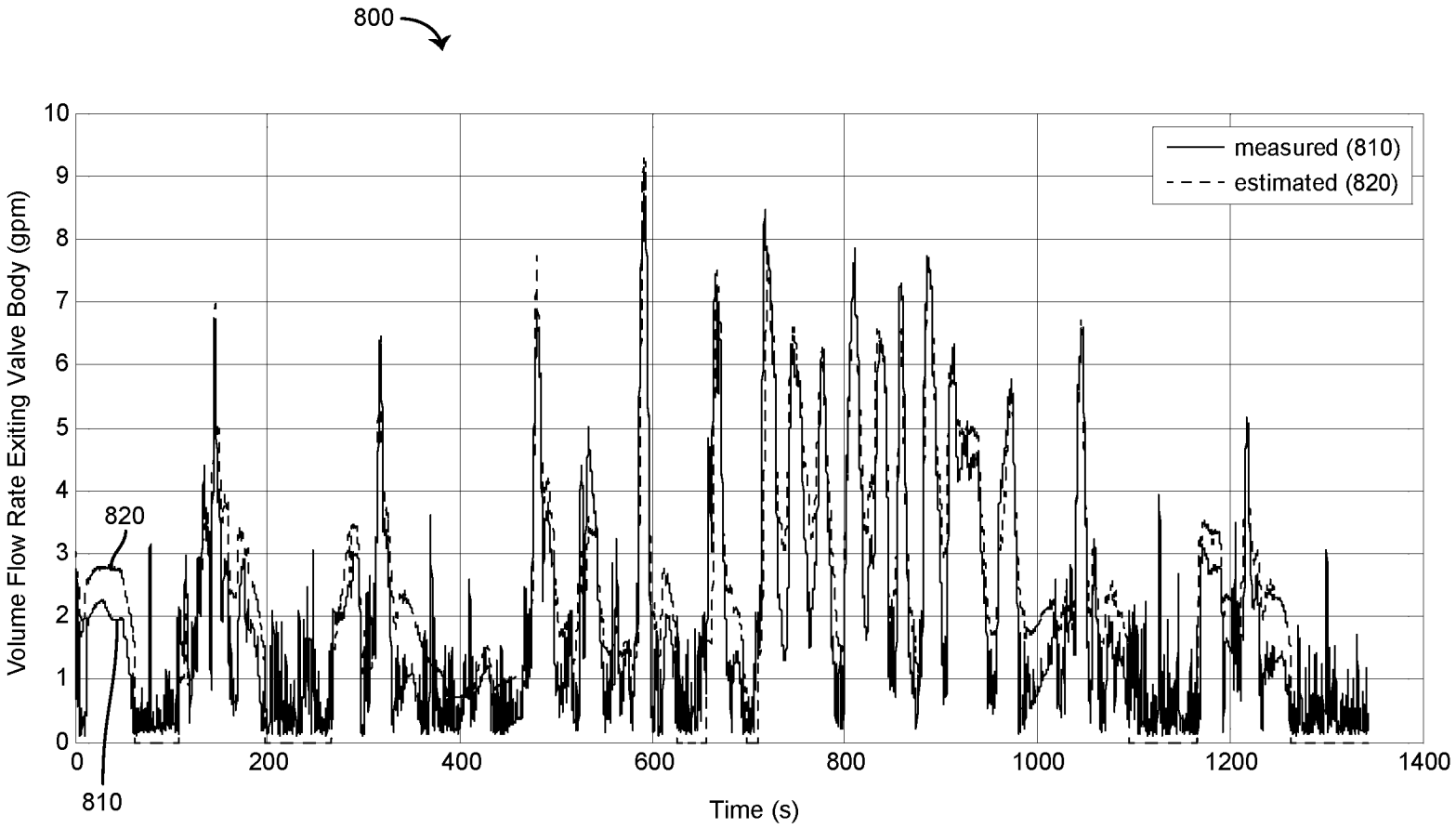
FIG. 8 is a graph of a measured and an estimated volume flow rate exiting a valve body of the waste heat recovery system over time, according to an example embodiment.

Referring now to FIG. 8, a graph 800 of a measured and an estimated volume flow rate exiting a valve body of the WHR system 12 over time is shown according to an example embodiment. As shown in FIG. 8, the graph 800 includes measured flow data 810 and estimated flow data 820. The measured flow data 810 represents the actual flow rate of the working fluid exiting the second valve 26 of the valve body 22 for various engine speeds and valve positions during operation of the WHR system 12. The estimated flow data 820 represents the estimated flow rate of the working fluid exiting the second valve 26 of the valve body 22 by the flow circuit 158 for various speeds of the engine 100 (e.g., indicated by the engine data 170, etc.) and valve positions of the first valve 24 and the second valve 26 (e.g., indicated by the valve position data 174, etc.) during operation of the WHR system 12. As shown in FIG. 8, the flow circuit 158 is capable of estimating the flow rate of the working fluid exiting the second valve 26 based on the speed of the engine 100, the speed of the feedpump 34, the pressure of the working fluid exiting the second valve 26, and/or the position of the first and second valves 24 and 26 with minimal or no error.

Referring back to FIG. 1-2, the pressure circuit 159 is structured to determine and/or estimate the pressure of the working fluid at various locations of the WHR system 12 based on various operating characteristics of the WHR system 12 and/or the engine 100. The pressure circuit 159 may receive the engine data 170, the pump data 172, the valve position data 174, and/or flow rate data from one or more of the engine circuit 155, the pump circuit 156, the valve circuit 157, and/or the flow circuit 158 to estimate the pressure of the working fluid. In some embodiments, the pressure circuit 159 is or includes one or more pressure sensors (e.g., the pressure sensors 130 and 132, etc.) to acquire pressure data 176 indicative of the pressure of the working fluid within the WHR system 12. As such, the pressure circuit 159 may include communication circuitry (e.g., relays, wiring, network interfaces, circuits, etc.) that facilitate the exchange of information, data, values, non-transient signals, etc. between and among the circuits 155, 156, 157, 158, 159 and the pressure sensors 130 and 132.

The pressure circuit 159 is structured to receive pressure data 176 (e.g., from the second pressure sensor 132, etc.) indicative of the pressure of the working fluid at the exit of the second valve 26 of the valve body 22. In one embodiment, the pressure data 176 is indicative of the pressure of the working fluid entering at least one of the third flow path 54 and the fourth flow path 56. The pressure circuit 159 is further structured to estimate (e.g., using the flow circuit 158) a change in the pressure of the working fluid across the WHR system 12 based on the flow rate of the working fluid at the exit of the second valve 26 and entrance of at least one of the third flow path 54 and the fourth flow path 56.

Figure 9:
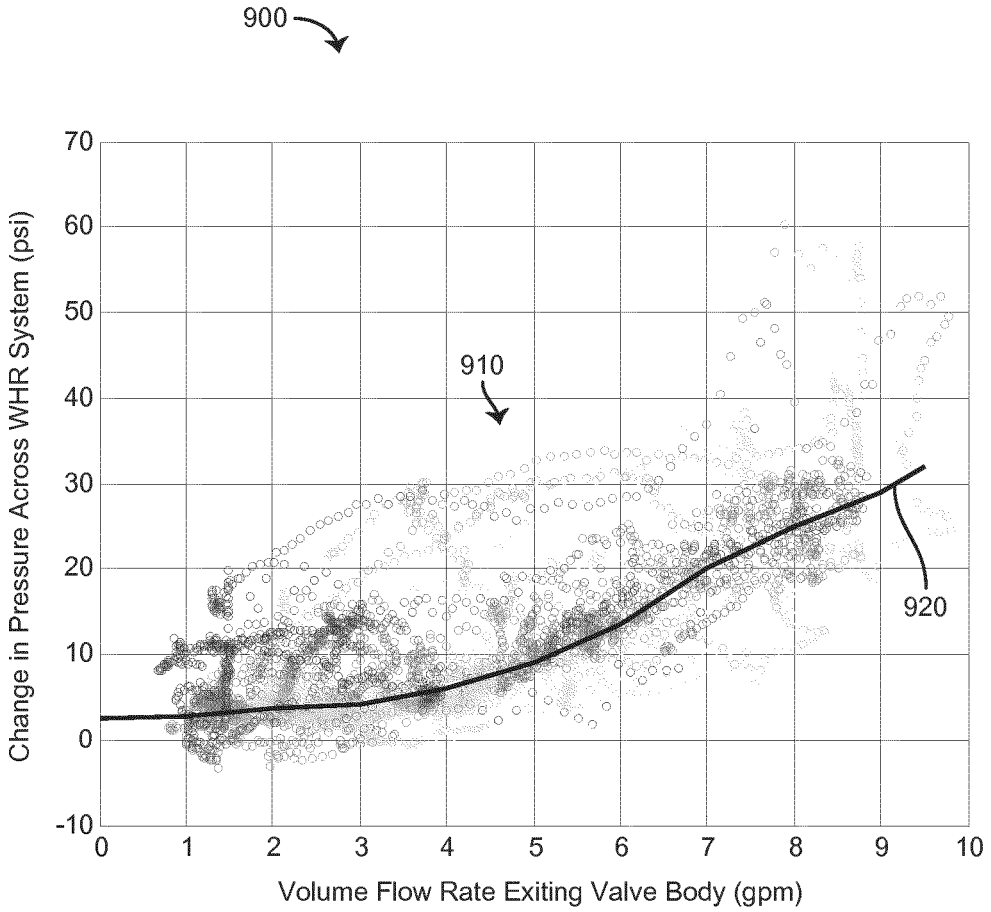
FIG. 9 is a graph of a change in pressure across the waste heat recovery system based on a volume flow rate exiting a valve body, according to an example embodiment.

In one embodiment, the pressure circuit 159 is structured to estimate the pressure of the working fluid within the hot section 16 of the WHR system 12 between the exhaust gas heat exchanger 64 and the EGR superheater 62. Referring to FIG. 9, a graph 900 of a change in pressure across the WHR system 12 based on a volume flow rate exiting a valve body is shown according to an example embodiment. As shown in FIG. 9, the graph 900 includes measured pressure data 910 and a pressure regression curve 920. The measured pressure data 910 represents the change in the pressure of the working fluid across the WHR system 12 (e.g., between the second pressure sensor 132 and the first virtual pressure sensor 134, etc.) according to an example embodiment. The pressure regression curve 920 may be fit to the measured pressure data 910 to determine the change in the pressure of the working fluid as a function of flow rate exiting the valve body 22 for a given WHR system. Thus, the pressure circuit 159 may be structured to estimate the change in the pressure of the working fluid across the WHR system 12 between the second pressure sensor 132 and the first virtual pressure sensor 134 using a look-up table, an algorithm, a model, and/or the like for a respective architecture of the WHR system 12. For example, the pressure circuit 159 may estimate the change in pressure based on the various flow losses due to the components and piping the working fluid flows through between the second pressure sensor 132 and the first virtual pressure sensor 134.

The pressure circuit 159 is further structured to determine the pressure of the working fluid in the hot section 16 between the exhaust gas heat exchanger 64 and the EGR superheater 62 based on information received from the second pressure sensor 132. According to an example embodiment, the pressure of the working fluid in the hot section 16 between the exhaust gas heat exchanger 64 and the EGR superheater 62 is based on (e.g., the difference between) the pressure of the working fluid at the exit of the second valve 26 of the valve body 22 (e.g., as measured by the second pressure sensor 132, etc.) and the change in the pressure of the working fluid across the WHR system (e.g., as estimated by the pressure circuit 159, etc.). In one non-limiting exemplary embodiment, the pressure of the working fluid in the hot section 16 of the WHR system 12 may be determined based on the following relationship (Equation 2):

$$P_{hot}=P_{valve}-\Delta P_{WHR}$$

where $P_{hot}$ is the pressure of the working fluid in the hot section 16 of the WHR system 12, $P_{valve}$ is the pressure of the working fluid exiting the second valve 26, and $\Delta P_{WHR}$ is the change in the pressure of the working fluid across the WHR system 12. In some embodiments, the controller 150 is structured to control and/or adjust the control of one or more components of the engine system 10 and/or the waste heat recovery (WHR) system 12 based on the determined pressure of the working fluid in the hot section 16. In some embodiments, the controller 150 is structured to provide an alert in response to the determined pressure of the working fluid in the hot section 16 exceeding or falling below a threshold pressure value. In some embodiments, the controller 150 is structure to store the determined pressure of the working fluid in the hot section 16 for data tracking purposes, analysis, and/or monitoring.

Figure 10:
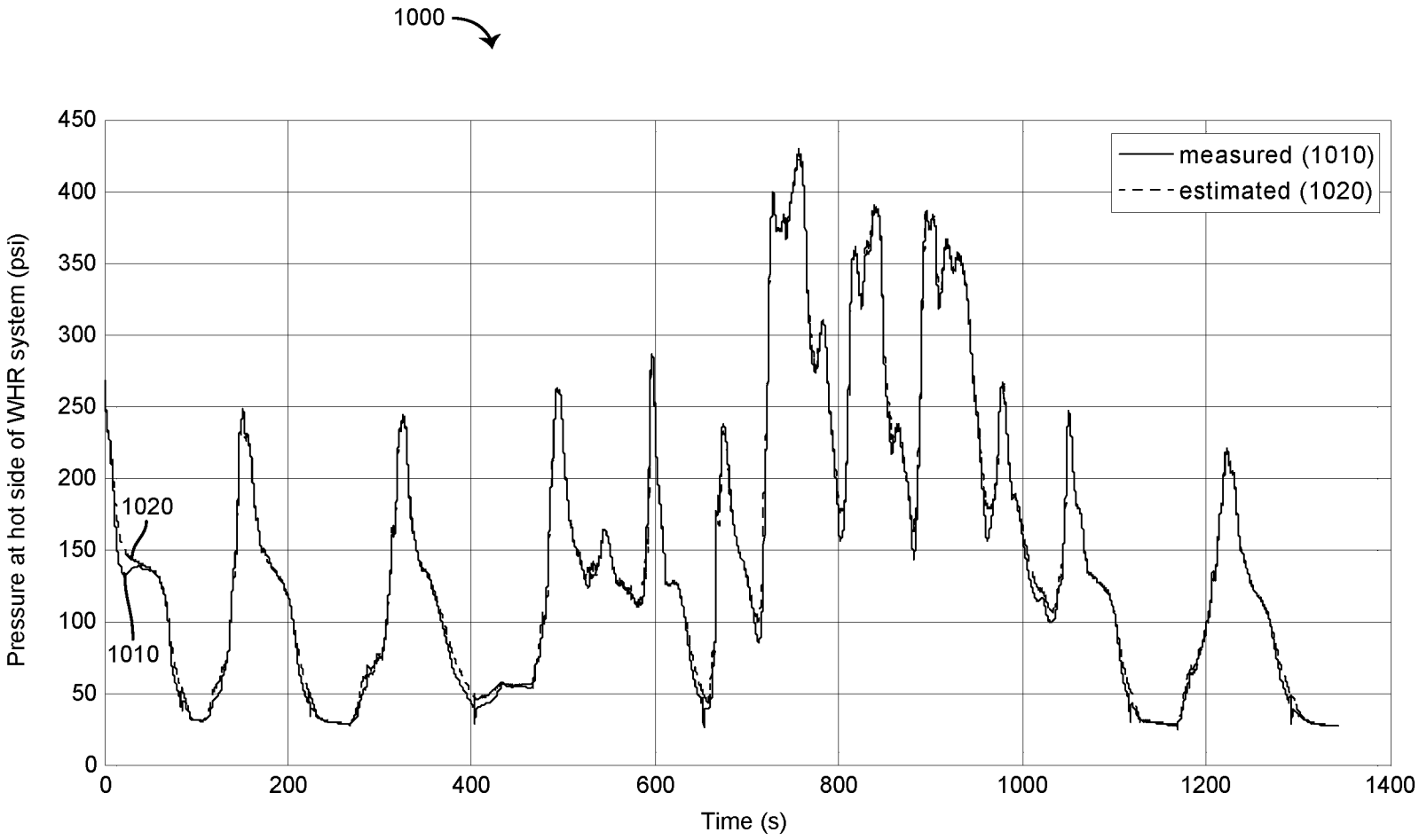
FIG. 10 is a graph of a measured and an estimated pressure at a hot side of the waste heat recovery system over time, according to an example embodiment.

Referring now to FIG. 10, a graph 1000 of a measured and an estimated pressure at a hot side of the WHR system 12 over time is shown according to an example embodiment. As shown in FIG. 10, the graph 1000 includes measured pressure data 1010 and estimated pressure data 1020. The measured pressure data 1010 represents the actual pressure of the working fluid between the exhaust gas heat exchanger 64 and the EGR superheater 62 in the hot section 16 for various engine speeds and valve positions during operation of the WHR system 12. The estimated pressure data 1020 represents the estimated pressure of the working fluid between the exhaust gas heat exchanger 64 and the EGR superheater 62 in the hot section 16 by the pressure circuit 159 for various speeds of the engine 100 (e.g., indicated by the engine data 170, etc.) and valve positions of the first valve 24 and the second valve 26 (e.g., indicated by the valve position data 174, etc.) during operation of the WHR system 12. As shown in FIG. 10, the pressure circuit 159 is may be structured to estimate the pressure of the working fluid within the hot section 16 based on the change in pressure across the WHR system 12, the pressure of the working fluid exiting the valve body 22, and the flow rate of the working fluid exiting the valve body 22 with minimal or no error.

Figure 11:
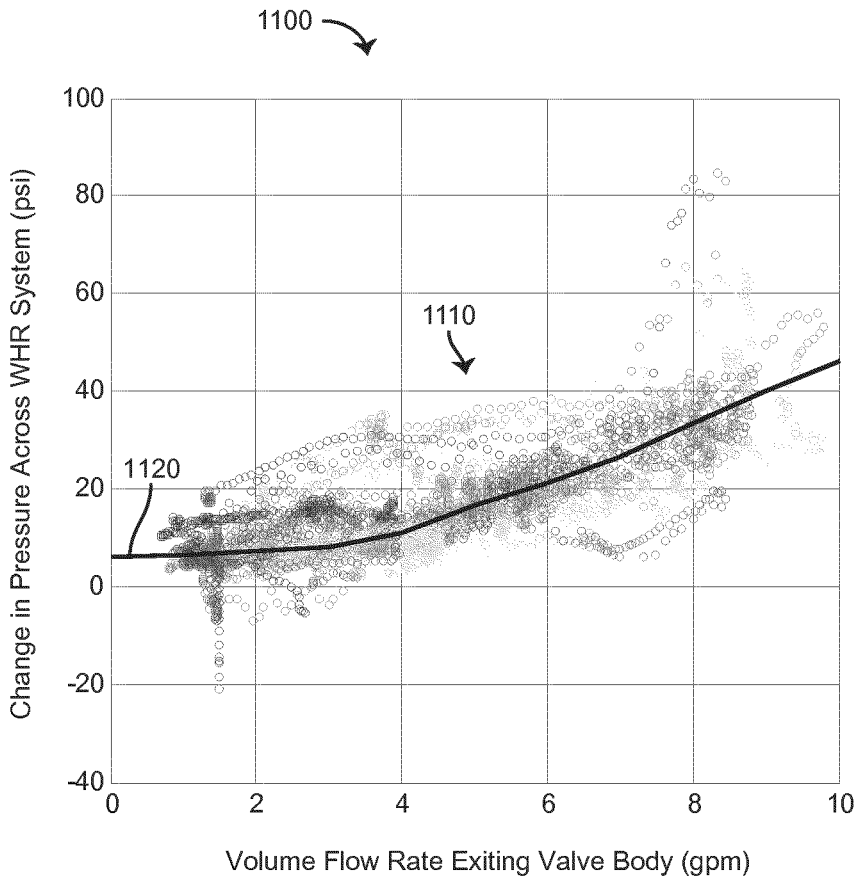
FIG. 11 is a graph of a change in pressure across the waste heat recovery system based on a volume flow rate exiting a valve body, according to another example embodiment.

In some embodiments, the pressure circuit 159 is structured to estimate the pressure of the working fluid within the hot section 16 of the WHR system 12 between the EGR superheater 62 and the energy conversion system 104. Referring to FIG. 11, a graph 1100 of a change in pressure across the WHR system 12 based on a volume flow rate exiting a valve body is shown according to an example embodiment. As shown in FIG. 11, the graph 1100 includes measured pressure data 1110 and a pressure regression curve 1120. The measured pressure data 1110 represents the change in the pressure of the working fluid across the WHR system 12 (e.g., between the second pressure sensor 132 and the second virtual pressure sensor 136, etc.) according to an example embodiment. The pressure regression curve 1120 may be fit to the measured pressure data 1110 to determine the change in the pressure of the working fluid as a function of flow rate exiting the valve body 22 for a given WHR system. Thus, the pressure circuit 159 may be structured to estimate the change in the pressure of the working fluid across the WHR system 12 between the second pressure sensor 132 and the second virtual pressure sensor 136 using a look-up table, an algorithm, a model, and/or the like for the WHR system 12. For example, the pressure circuit 159 may estimate the change in pressure of the working fluid based on various flow losses due to the components and piping that the working fluid flows through between the second pressure sensor 132 and the second virtual pressure sensor 136.

The pressure circuit 159 is further structured to determine the pressure of the working fluid in the hot section 16 between the EGR superheater 62 and the energy conversion system 104 based on information received from the second virtual pressure sensor 136. According to an example embodiment, the pressure of the working fluid in the hot section 16 between the EGR superheater 62 and the energy conversion system 104 is based on (e.g., the difference between) the pressure of the working fluid at the exit of the second valve 26 of the valve body 22 (e.g., as measured by the second pressure sensor 132, etc.) and the change in the pressure of the working fluid across the WHR system (e.g., as estimated by the pressure circuit 159, etc.).

Figure 12:
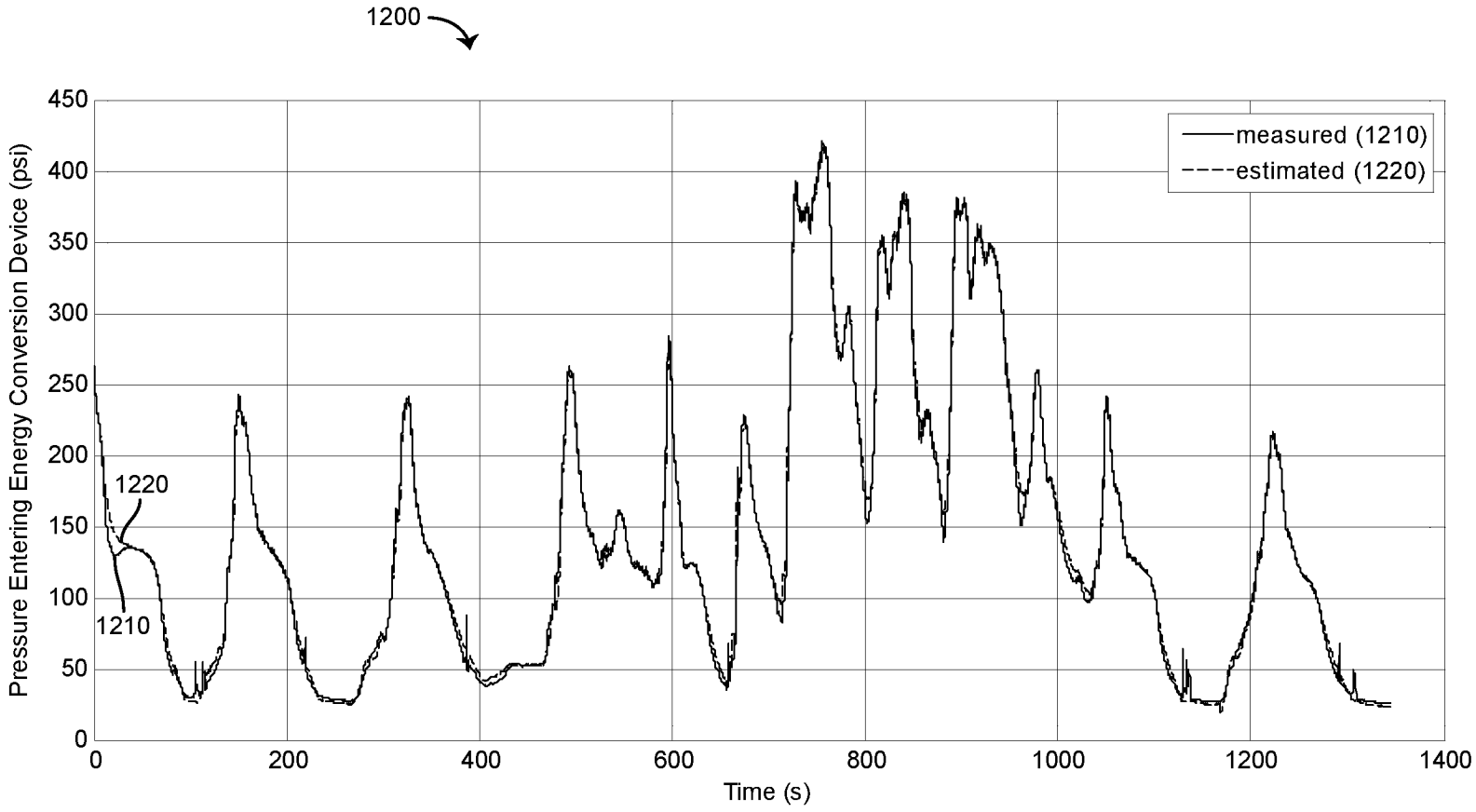
FIG. 12 is a graph of a measured and an estimated pressure at a hot side of the waste heat recovery system over time, according to another example embodiment.

Referring now to FIG. 12, a graph 1200 of a measured and an estimated pressure at a hot side of the WHR system 12 over time is shown according to an example embodiment. As shown in FIG. 12, the graph 1200 includes measured pressure data 1210 and estimated pressure data 1220. The measured pressure data 1210 represents the actual pressure of the working fluid between the EGR superheater 62 and the energy conversion system 104 in the hot section 16 for various engine speeds and valve positions during operation of the WHR system 12. The estimated pressure data 1220 represents the estimated pressure of the working fluid between the EGR superheater 62 and the energy conversion system 104 in the hot section 16 by the pressure circuit 159 for various speeds of the engine 100 (e.g., indicated by the engine data 170, etc.) and valve positions of the first valve 24 and the second valve 26 (e.g., indicated by the valve position data 174, etc.) during operation of the WHR system 12. As shown in FIG. 12, the pressure circuit 159 may be structured to estimate the pressure of the working fluid within the hot section 16 based on the change in pressure across the WHR system 12, the pressure of the working fluid exiting the valve body 22, and the flow rate of the working fluid exiting the valve body 22 with minimal or no error.

Figure 13:
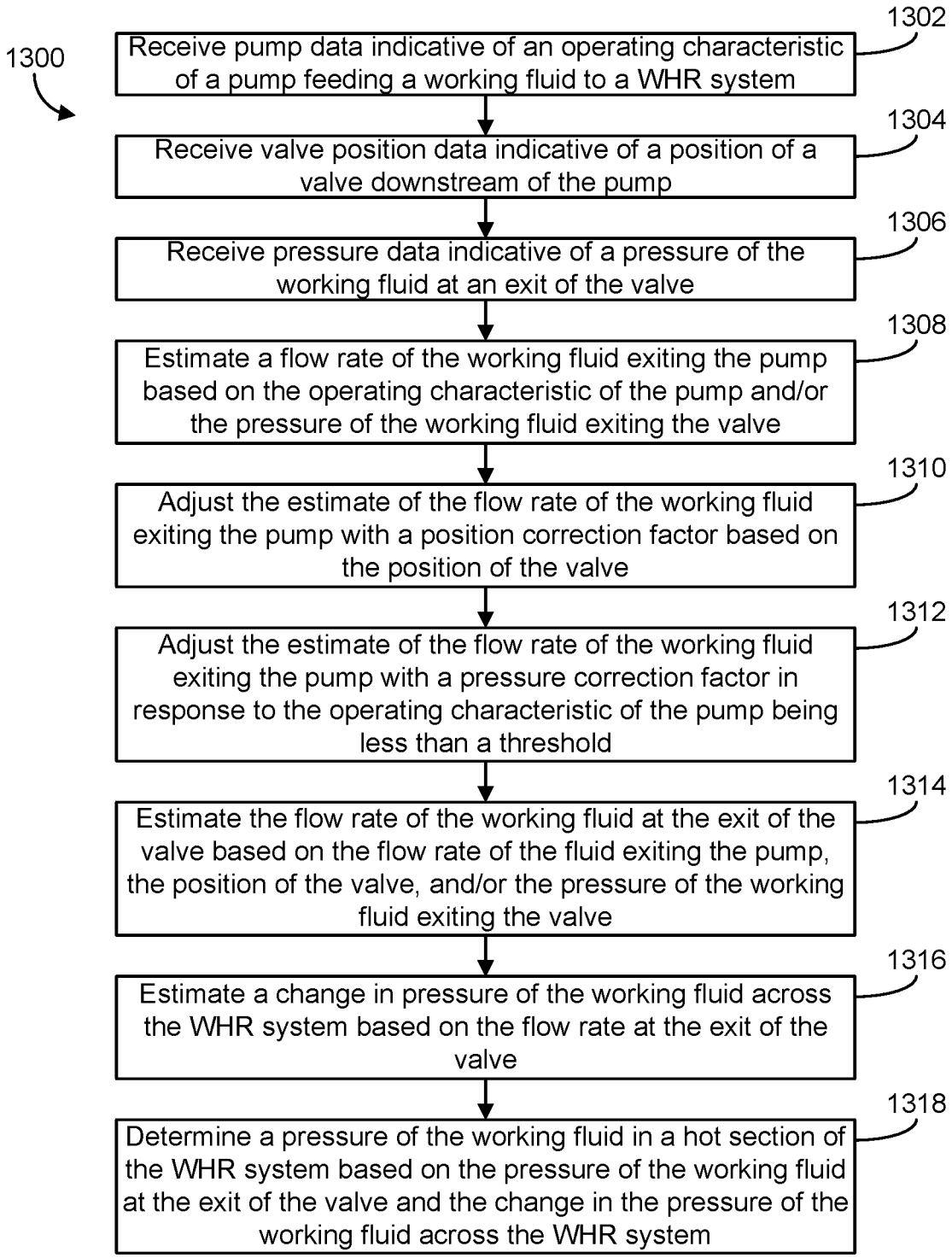
FIG. 13 is a flow diagram of a method for determining a pressure of a working fluid in a hot section of the waste heat recovery system, according to an example embodiment.

Referring now to FIG. 13, a flow diagram of a method 1300 for determining a pressure of a working fluid in a hot section of the WHR system 12 is shown according to an example embodiment. Method 1300 may be implemented with the controller 150 of FIGS. 1-2.

At process 1302, the controller 150 is structured to receive pump data (e.g., the pump data 172, etc.) indicative of an operating characteristic (e.g., pump speed, etc.) of a pump (e.g., the feedpump 34, etc.) feeding a working fluid to a WHR system (e.g., the WHR system 12, etc.). In one embodiment, the operating characteristic of the pump is associated with a speed of the engine 100 driving the pump. The speed of the engine 100 may be indicated by the engine data 170. At process 1304, the controller 150 is structured to receive valve position data (e.g., the valve position data 174, etc.) indicative of a position of a valve (e.g., the first valve 24, the second valve 26, etc.) downstream of the pump. At process 1306, the controller 150 is structured to receive pressure data (e.g., the pressure data 176, from the second pressure sensor 132, etc.) indicative of a pressure of the working fluid exiting the valve (e.g., the second valve 26, etc.).

At process 1308, the controller 150 is structured to estimate a flow rate of the working fluid exiting the pump based on the operating characteristic of the pump and/or the pressure of the working fluid exiting the valve. At process 1310, the controller 150 is structured to adjust the estimate of the flow rate of the working fluid exiting the pump with a position correction factor based on the position of the valve (e.g., the first valve 24, etc.). At process 1312, the controller 150 is structured to adjust the estimate of the flow rate of the working fluid exiting the pump with a pressure correction factor (e.g., based on the pressure data, etc.) in response to the operating characteristic of the pump being less than a threshold value. For example, at engine idle, the engine may drive the pump at a low speed resulting in a low working fluid flow rate causing errors in the flow rate estimate. At process 1314, the controller 150 is structured to estimate the flow rate of the working fluid at an exit of the valve (e.g., the second valve 26, etc.) based on the flow rate of the working fluid exiting the pump, the position of the valve (e.g., the first valve 24 and the second valve 26, etc.), and/or the pressure of the working fluid exiting the valve.

At process 1316, the controller 150 is structured to estimate a change in pressure of the working fluid across the WHR system 12 based on the flow rate at the exit of the valve (e.g., the second valve 26, etc.). The change in the pressure across the WHR system 12 may be caused by the architecture of the WHR system 12 (e.g., component layout, flow losses in the piping and components, etc.). The change in the pressure may be between the exit of the valve (e.g., the second valve 26, etc.) and a component of the WHR system 12 (e.g., the EGR superheater 62, the energy conversion system 104, etc.) located in a hot section (e.g., the hot section 16, etc.) of the WHR system 12. At process 1318, the controller 150 is structured to determine a pressure of the working fluid in the hot section of the WHR system 12 based on the pressure of the working fluid at the exit of the valve and the change in the pressure of the working fluid across the WHR system 12 (e.g., the difference between the pressure at the exit of the valve and the change in the pressure across the WHR system 12, etc.). By way of example, the pressure of the working fluid in the hot section 16 may be determined between an EGR superheater 62 and the energy conversion system 104 and/or the exhaust gas heat exchanger 64 and the EGR superheater 62. In some embodiments, the pressure and/or flow rates of the working fluid are estimated in other locations of the WHR system 12. The determined pressure and/or flow rates may be used by the controller 150 to control various components of the WHR system 12, to provide an alert (e.g., in response to the pressure and/or flow rates exceeding and/or falling below a threshold value, etc.), and/or for storage, data tracking, and/or other analysis.

According to one embodiment, the circuits 155, 156, 157, 158, and 159 may include communication circuitry structured to facilitate the exchange of information, data, values, non-transient signals, etc. between and among the circuits 155, 156, 157, 158, and 159, the various sensors of the engine system 10, and/or the components of the engine system 10. For example, the communication circuitry may include a channel comprising any type of communication channel (e.g., fiber optics, wired, wireless, etc.), wherein the channel may include any additional component for signal enhancement, modulation, demodulation, filtering, and the like. In this regard, the circuits 155, 156, 157, 158, and/or 159 may include communication circuitry including, but not limited to, wired and wireless communication protocol to facilitate reception of the engine data 170, the pump data 172, the valve position data 174, and/or the pressure data 176. In another embodiment, the circuits 155, 156, 157, 158, and 159 may include machine-readable media stored by the memory 154 and executable by the processor 152, wherein the machine-readable media facilitates performance of certain operations to receive the engine data 170, the pump data 172, the valve position data 174, and/or the pressure data 176. For example, the machine-readable media may provide an instruction (e.g., command, etc.) to the second pressure sensor 132 operatively coupled to the second valve 26 to monitor and acquire the pressure data 176. In this regard, the machine-readable media may include programmable logic that defines the frequency of acquisition of the engine data 170, the pump data 172, the valve position data 174, and/or the pressure data 176. In yet another embodiment, the circuits 155, 156, 157, 158, and 159 may include any combination of machine-readable content, communication circuitry, the various sensors, and/or the various components of the engine system 10.

It should be understood that no claim element herein is to be construed under the provisions of 35 U.S.C. § 112(f), unless the element is expressly recited using the phrase "means for." The schematic flow chart diagrams and method schematic diagrams described above are generally set forth as logical flow chart diagrams. As such, the depicted order and labeled steps are indicative of representative embodiments. Other steps, orderings and methods may be conceived that are equivalent in function, logic, or effect to one or more steps, or portions thereof, of the methods illustrated in the charts and diagrams.

Additionally, the format and symbols employed are provided to explain the logical steps of the diagrams and are understood not to limit the scope of the methods illustrated by the diagrams. Although various arrow types and line types may be employed in the schematic diagrams, they are understood not to limit the scope of the corresponding methods. Indeed, some arrows or other connectors may be used to indicate only the logical flow of a method. For instance, an arrow may indicate a waiting or monitoring period of unspecified duration between enumerated steps of a depicted method. Additionally, the order in which a particular method occurs may or may not strictly adhere to the order of the corresponding steps shown. It will also be noted that each block of the block diagrams and/or flowchart diagrams, and combinations of blocks in the block diagrams and/or flowchart diagrams, can be implemented by special purpose hardware-based systems that perform the specified functions or acts, or combinations of special purpose hardware and program code.

Many of the functional units described in this specification have been labeled as circuits to more particularly emphasize their implementation independence. For example, a circuit may be implemented as a hardware circuit comprising custom VLSI circuits or gate arrays, off-the-shelf semiconductors such as logic chips, transistors, or other discrete components. A circuit may also be implemented in programmable hardware devices such as field programmable gate arrays, programmable array logic, programmable logic devices or the like.

Circuits may also be implemented in machine-readable medium for execution by various types of processors. An identified circuit of executable code may, for instance, comprise one or more physical or logical blocks of computer instructions, which may, for instance, be organized as an object, procedure, or function. Nevertheless, the executables of an identified circuit need not be physically located together, but may comprise disparate instructions stored in different locations which, when joined logically together, comprise the circuit and achieve the stated purpose for the circuit.

A circuit of computer readable program code may be a single instruction, or many instructions, and may even be distributed over several different code segments, among different programs, and across several memory devices. Similarly, operational data may be identified and illustrated herein within circuits, and may be embodied in any suitable form and organized within any suitable type of data structure. The operational data may be collected as a single data set, or may be distributed over different locations including over different storage devices, and may exist, at least partially, merely as electronic signals on a system or network. Where a circuit or portions of a circuit are implemented in machine-readable medium (or computer-readable medium), the computer readable program code may be stored and/or propagated on in one or more computer readable medium(s).

The computer readable medium may be a tangible computer readable storage medium structured to store the computer readable program code. The computer readable storage medium may be but is not limited to, for example, an electronic, magnetic, optical, electromagnetic, infrared, holographic, micromechanical, or semiconductor system, apparatus, or device, or any suitable combination of the foregoing.

Specific examples of the computer readable medium may include but are not limited to a portable computer diskette, a hard disk, a random access memory (RAM), a read-only memory (ROM), an erasable programmable read-only memory (EPROM or Flash memory), a portable compact disc read-only memory (CD-ROM), a digital versatile disc (DVD), an optical storage device, a magnetic storage device, a holographic storage medium, a micromechanical storage device, or any suitable combination of the foregoing. In the context of this document, a computer readable storage medium may be any tangible medium that can contain, and/or store computer readable program code for use by and/or in connection with an instruction execution system, apparatus, or device.

The computer readable medium may also be a computer readable signal medium. A computer readable signal medium may include a propagated data signal with computer readable program code embodied therein, for example, in baseband or as part of a carrier wave. Such a propagated signal may take any of a variety of forms, including, but not limited to, electrical, electro-magnetic, magnetic, optical, or any suitable combination thereof. A computer readable signal medium may be any computer readable medium that is not a computer readable storage medium and that can communicate, propagate, or transport computer readable program code for use by or in connection with an instruction execution system, apparatus, or device. Computer readable program code embodied on a computer readable signal medium may be transmitted using any appropriate medium, including but not limited to wireless, wireline, optical fiber cable, Radio Frequency (RF), or the like, or any suitable combination of the foregoing.

In one embodiment, the computer readable medium may comprise a combination of one or more computer readable storage mediums and one or more computer readable signal mediums. For example, computer readable program code may be both propagated as an electro-magnetic signal through a fiber optic cable for execution by a processor and stored on a RAM storage device for execution by the processor.

Computer readable program code for carrying out operations for aspects of the present disclosure may be written in any combination of one or more programming languages, including an object oriented programming language such as Java, Smalltalk, C++ or the like and conventional procedural programming languages, such as the "C" programming language or similar programming languages. The computer readable program code may execute entirely on the user's computer, partly on the user's computer, as a stand-alone computer-readable package, partly on the user's computer and partly on a remote computer or entirely on the remote computer or server.

The program code may also be stored in a computer readable medium that can direct a computer, other programmable data processing apparatus, or other devices to function in a particular manner, such that the instructions stored in the computer readable medium produce an article of manufacture including instructions which implement the function/act specified in the schematic flowchart diagrams and/or schematic block diagrams block or blocks.

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Accordingly, the present disclosure may be embodied in other specific forms without departing from its spirit or essential characteristics. The described embodiments are to be considered in all respects only as illustrative and not restrictive. The scope of the disclosure is therefore indicated by the appended claims rather than by the foregoing description. All changes which come within the meaning and range of equivalency of the claims are to be embraced within their scope.

What is claimed is:

1. A method, comprising:

receiving pump data indicative of an operating characteristic of a pump feeding a fluid to a waste heat recovery (WHR) system;

receiving valve position data indicative of a position of a valve downstream of the pump;

receiving pressure data indicative of a pressure of the fluid near an exit of the valve;

estimating a flow rate of the fluid exiting the pump based on at least one of the operating characteristic of the pump and the pressure of the fluid near the exit of the valve;

estimating the flow rate of the fluid near the exit of the valve based on at least one of the flow rate of the fluid exiting the pump, the pressure of the fluid near the exit of the valve, and the position of the valve;

estimating a change in pressure of the fluid across the WHR system based on the flow rate of the fluid near the exit of the valve;

determining a pressure of the fluid in a section of the WHR system that includes a heat exchange system based on the pressure of the fluid near the exit of the valve and the change in the pressure of the fluid across the WHR system; and at least one of controlling a component of the WHR system and providing an alert based on the determined pressure of the fluid in the section of the WHR system that includes the heat exchange system.

2. The method of claim 1, further comprising selectively controlling the position of the valve.

3. The method of claim 2, wherein the section of the WHR system is a first section of the WHR system, and wherein selectively controlling the position of the valve includes selectively engaging the valve to direct a portion of the fluid exiting the pump to at least one of the first section and a second section of the WHR system, wherein the second section includes a fluid management cooling system.

4. The method of claim 1, wherein the section of the WHR system is a first section of the WHR system, and wherein the position of the valve is indicative of an amount of the fluid exiting the pump that enters at least one of the first section and a second section of the WHR system, wherein the second section includes a fluid management cooling system.

5. The method of claim 1, further comprising adjusting the estimate of the flow rate of the fluid exiting the pump with a position correction factor based on the position of the valve.

6. The method of claim 1, further comprising receiving engine data indicative of an engine speed of an engine, wherein the operating characteristic of the pump includes a pump speed, and wherein the pump speed is determined based on the engine speed.

7. The method of claim 6, further comprising adjusting the estimate of the flow rate of the fluid exiting the pump with a pressure correction factor in response to the engine data indicating the engine speed is below a speed threshold.

8. A method, comprising:

receiving valve position data indicative of a position of a valve positioned to selectively direct a fluid to at least one of a first flow path and a second flow path of a waste heat recovery (WHR) system;

receiving pressure data indicative of a pressure of the fluid near an exit of the valve;

estimating a flow rate of the fluid near the exit of the valve based on at least one of the flow rate of the pressure of the fluid near the exit of the valve and the position of the valve;

estimating a change in pressure of the fluid across the WHR system based on the flow rate of the fluid near the exit of the valve;

determining a pressure of the fluid in a section of the WHR system coupled to the first flow path based on the pressure of the fluid near the exit of the valve and the change in the pressure of the fluid across the WHR system, the section of the WHR system including a heat exchange system; and at least one of controlling a component of the WHR system and providing an alert based on the determined pressure of the fluid in the section of the WHR system that includes the heat exchange system.

9. The method of claim 8, wherein the valve is positioned downstream of a pump feeding fluid to the WHR.

10. The method of claim 8, further comprising selectively controlling the position of the valve.

11. The method of claim 10, wherein the section of the WHR system is a first section of the WHR system, and wherein selectively controlling the position of the valve includes selectively engaging the valve to direct a portion of the fluid exiting the pump to at least one of the first section and a second section of the WHR system coupled to the second flow path, wherein the second section includes a fluid management cooling system.

12. The method of claim 11, wherein the valve is a first valve and further comprising a second valve downstream of and fluidly coupled to the first valve, and further comprising selectively controlling a position of the second valve to direct a portion of the fluid received from the first valve to at least one of a third flow path and a fourth flow path of the WHR system, wherein the third flow path and the fourth flow path are fluidly coupled to the first section of the WHR system.

13. The method of claim 12, wherein the change in the pressure of the fluid across the WHR system is based on the flow rate of the fluid though at least one of the third flow path and the fourth flow path of the WHR system.

14. The method of claim 12, wherein the portion of the fluid directed to the at least one of the third flow path and the fourth flow path of the WHR system is based on the position of the second valve.

15. The method of claim 8, wherein the section of the WHR system is a first section of the WHR system, and wherein the position of the valve is indicative of an amount of the fluid exiting the pump that enters at least one of the first section and a second section of the WHR system, wherein the second section includes a fluid management cooling system.

16. A method, comprising:

receiving pump data indicative of an operating characteristic of a pump feeding a fluid to a waste heat recovery (WHR) system;

receiving pressure data indicative of a pressure of the fluid near an exit of a valve downstream of the pump;

estimating a flow rate of the fluid exiting the pump based on at least one of the operating characteristic of the pump and the pressure of the fluid near the exit of the valve;

estimating the flow rate of the fluid near the exit of the valve based on at least one of the flow rate of the fluid exiting the pump and the pressure of the fluid near the exit of the valve;

estimating a change in pressure of the fluid across the WHR system based on the flow rate of the fluid near the exit of the valve;

determining a pressure of the fluid in a section of the WHR system that includes a heat exchange system based on the pressure of the fluid near the exit of the valve and the change in the pressure of the fluid across the WHR system; and at least one of controlling a component of the WHR system and providing an alert based on the determined pressure of the fluid in the section of the WHR system that includes the heat exchange system.

17. The method of claim 16, wherein the section of the WHR system is a first section of the WHR system, and further comprising selectively controlling a position of the valve to direct a portion of the fluid exiting the pump to at least one of the first section and a second section of the WHR system, wherein the second section includes a fluid management cooling system.

18. The method of claim 17, further comprising adjusting the estimate of the flow rate of the fluid exiting the pump with a position correction factor based on the position of the valve.

19. The method of claim 16, further comprising receiving engine data indicative of an engine speed of an engine, wherein the operating characteristic of the pump includes a pump speed, and wherein the pump speed is determined based on the engine speed.

20. The method of claim 19, further comprising adjusting the estimate of the flow rate of the fluid exiting the pump with a pressure correction factor in response to the engine data indicating the engine speed is below a speed threshold.

* * * * *